US007510277B2

(12) United States Patent
Konno et al.

(10) Patent No.: US 7,510,277 B2
(45) Date of Patent: Mar. 31, 2009

(54) IMAGE FORMING APPARATUS AND METHOD

(75) Inventors: Masaaki Konno, Kanagawa (JP); Tetsuzo Kadomatsu, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 196 days.

(21) Appl. No.: 11/067,358

(22) Filed: Feb. 28, 2005

(65) Prior Publication Data

US 2005/0190248 A1 Sep. 1, 2005

(30) Foreign Application Priority Data

Mar. 1, 2004 (JP) ..... 2004-056215
Mar. 30, 2004 (JP) ..... 2004-100901

(51) Int. Cl.
*B41J 2/01* (2006.01)

(52) U.S. Cl. ..... 347/102; 347/101; 347/17

(58) Field of Classification Search ..... 347/102, 347/101, 5, 6, 9, 14, 16, 17, 19, 100, 95, 347/96

See application file for complete search history.

(56) References Cited

U.S. PATENT DOCUMENTS

| | | | | |
|---|---|---|---|---|
| 5,148,186 | A * | 9/1992 | Tochihara et al. | 347/51 |
| 6,523,948 | B2 * | 2/2003 | Matsumoto et al. | 347/102 |
| 6,550,906 | B2 * | 4/2003 | Ylitalo | 347/102 |
| 2004/0114016 | A1 * | 6/2004 | Yokoyama | 347/102 |
| 2004/0197682 | A1 | 10/2004 | Sonehara et al. | |
| 2006/0087543 | A2 * | 4/2006 | Iwase | 347/102 |

FOREIGN PATENT DOCUMENTS

| | | | |
|---|---|---|---|
| JP | 2-26747 | A | 1/1990 |
| JP | 8-85218 | A | 4/1996 |
| JP | 2001-1512 | A | 1/2001 |
| JP | 2002107528 | A | 4/2002 |
| JP | 2002-347232 | A | 12/2002 |
| JP | 2003-11341 | A | 1/2003 |
| JP | 2003-11343 | A | 1/2003 |
| JP | 2003-89198 | A | 3/2003 |
| JP | 2003-127338 | A | 5/2003 |
| JP | 2003-127347 | A | 5/2003 |
| JP | 2003-127517 | A | 5/2003 |
| JP | 2003-145725 | A | 5/2003 |
| JP | 2003-145741 | A | 5/2003 |
| JP | 2003-182048 | A | 7/2003 |

(Continued)

*Primary Examiner*—Manish S Shah
(74) *Attorney, Agent, or Firm*—Birch, Stewart, Kolasch & Birch, LLP

(57) ABSTRACT

The image forming apparatus includes: an ink discharge device having a plurality of full line type inkjet heads, each of the inkjet heads having a nozzle row; an ink supply device; a first curing device which irradiates ultraviolet light for causing the droplets of the ink to semi-cure to a degree whereby the droplets of the ink discharged from the inkjet head on the upstream side do not mix with the droplets of the ink discharged by a next one of the inkjet heads situated on a downstream side in the direction of relative conveyance, the first curing device including an ultraviolet light source including a group of light emitting elements arranged in a linear form and disposed between the inkjet heads of the respective colors; and a second curing device which irradiates ultraviolet light for performing main curing of the droplets of the ink.

34 Claims, 19 Drawing Sheets

FOREIGN PATENT DOCUMENTS

| | | | |
|---|---|---|---|
| JP | 2003-191594 | A | 7/2003 |
| JP | 2003-211651 | A | 7/2003 |
| JP | 2003-246051 | A | 9/2003 |
| JP | 2004-9483 | A | 1/2004 |
| JP | 2004-42548 | A | 2/2004 |

* cited by examiner

IMAGE FORMING APPARATUS AND METHOD

BACKGROUND OF THE INVENTION

1. Field of the Invention

The present invention relates to an image forming apparatus and method, and more particularly to an image forming apparatus and an image forming method which forms images on a recording medium by discharging ink from an inkjet head. Furthermore, the present invention relates to an image forming apparatus and an image forming method suitable for forming color images by discharging inks of a plurality of colors onto a recording medium by means of full line type inkjet heads having a nozzle row spanning a length corresponding to the entire printable width.

2. Description of the Related Art

There is an inkjet type image forming apparatus using ultraviolet curable ink (so-called UV ink). Japanese Patent Application Publication No. 2002-347232 discloses a technology comprising a heating unit for heating the ink provided between a full line type recording unit which discharges light-curable ink, and a light irradiating section for irradiating UV light for curing ink, onto ink that has been discharged onto a recording medium. The evaporation of the ink solvent is accelerated by the heating unit, and hence the speed of the curing speed of the ink becomes faster.

However, the action of the heating unit disclosed in Japanese Patent Application Publication No. 2002-347232 contributes to the evaporation of the ink solvent, while making little contribution to curing of the ink. Therefore, even if a heating unit is disposed immediately after each head, as illustrated in FIG. 7 of Japanese Patent Application Publication No. 2002-347232, droplets are still ejected from a subsequent (downstream) head while the ink discharged from an upstream head is in a liquid state on the recording medium, and hence there is interference between droplets on the surface of the recording medium, and bleeding of the colors due to color mixing. Consequently, image quality declines.

Japanese Patent Application Publication No. 2003-11341 discloses that an active light beam be irradiated within 10 seconds of the discharge of all inks required to form an image, when using inks of a plurality of colors. This composition is, however, for irradiating an activating light beam after inks of all of the required colors for image formation have been ejected, and therefore, similarly to Japanese Patent Application Publication No. 2002-347232, color bleeding occurs due to mixing of the colors.

Japanese Patent Application Publication No. 2003-127517 discloses that, after spraying ink droplets onto a recording medium, ultraviolet light having a wavelength of 340 to 400 nm is irradiated for 0.1 to 10 seconds, whereupon ultraviolet light having a wavelength of 280 to 400 nm is irradiated for 10 to 1000 seconds. Japanese Patent Application Publication No. 2003-127517 discloses that light is irradiated from a curing light source by dividing the wavelength range and the irradiation time of the curing light source into two stages; however, it does not disclose the positional relationship between the head and the irradiation light source, and it is unclear at what timing the irradiation of light is actually performed.

Japanese Patent Application Publication No. 2003-191594 discloses that a device is provided in order to vary the irradiation conditions of an activating light beam, as desired, after ink has been deposited. Japanese Patent Application Publication No. 2003-191594 describes varying the irradiation conditions of the activating light source, namely, the irradiation time, the irradiation timing, the irradiation intensity, the irradiation energy, the type of light source, the irradiation surface area, the angle of incidence, and the wavelength characteristics; however, it does not disclose a composition for the apparatus which indicates the positional relationship between the irradiation light source and the head, and it is unclear what kind of device (apparatus) is used to achieve this.

Japanese Patent Application Publication No. 2003-182048 discloses a method for forming images by creating print data in such a manner that there is no mutual interference between adjacently positioned dots on the recording medium, and repeating an operation of printing (discharging ink) and an operation of ultraviolet curing, on the basis of the print data. Japanese Patent Application Publication No. 2003-182048 forms an image progressively by repeating the operations of a print section and an ultraviolet curing section, and therefore it is difficult to achieve high-speed output. Furthermore, Japanese Patent Application Publication No. 2003-182048 does not describe the positional relationship between the head and the UV irradiation device.

Japanese Patent Application Publication No. 2003-11343 discloses a composition for a shuttle scan type inkjet recording apparatus which forms images by moving a recording head reciprocally, in which the deposition of ink onto the recording medium is divided into a plurality of actions based on the reciprocal movement of the recording head, and ultraviolet light is irradiated between each deposition action. Japanese Patent Application Publication No. 2003-11343 states that ink is fixed by irradiation of ultraviolet light between the respective ink deposition actions performed by a shuttle scanning type of system, and the amount of light irradiated must be sufficient to fix the ink. However, if ultraviolet light of an amount required to fix the ink is irradiated in the vicinity of the head, then the ink inside the nozzle is hardened by the random reflection from the print medium, and the like, and this can lead to discharge errors.

Japanese Patent Application Publication No. 2001-1512 discloses an inkjet printer comprising an image forming section which discharges ink onto paper in sheet form (print object) and a pressurizing section which pressurizes the printing object formed with an image by the image forming section. This printer is composed in such a manner that a gloss finish is applied to the image by pressurizing and flattening the surface undulations of the ink on the image formed on the print object by the image forming section. Japanese Patent Application Publication No. 2001-1512 is a technology which assumes that a pigment-based ink or dye-based ink is used as the printing ink. However, technology using ultraviolet curable type ink is known in inkjet type image forming apparatuses. Various merits are obtained by using an ultraviolet curable ink, namely, images can be formed onto recording media of various types and hence the recording medium can be selected from a wide range, and the like. However, if an ultraviolet curable ink is used within the technical scope described in Japanese Patent Application Publication No. 2001-1512, problems arise in that fracturing and peeling occurs in the ink surface when the ink is flattened by pressurization.

SUMMARY OF THE INVENTION

The present invention has been contrived in view of such circumstances, and an object thereof is to provide an image forming apparatus and method whereby image deterioration caused by bleeding between colors can be prevented, while also preventing hardening of the ink inside the nozzles. It is also an object of the present invention to provide an image forming apparatus and method which uses an ink that is curable by application of energy, such as an ultraviolet curable ink, or a phase change type of ink, such as a solid ink, which can achieve image fixing creating a glossy appearance, while avoiding cracking or peeling of the ink surface, and which can also prevent image deterioration caused by mixing of colors between inks of different colors when forming a color image.

In order to attain the aforementioned object, the present invention is directed to an image forming apparatus, comprising: an ink discharge device comprising a plurality of full line type inkjet heads arranged separately for a plurality of inks of different colors, each of the inkjet heads having a nozzle row in which a plurality of nozzles for discharging droplets of the ink toward a surface of a recording medium are arranged through a length corresponding to a full width of the recording medium; an ink supply device which supplies ultraviolet curable inks of corresponding colors to the inkjet heads; a conveyance device which causes the inkjet heads and the recording medium to move relatively to each other by conveying at least one of the recording medium and the inkjet heads in a direction substantially perpendicular to a breadthways direction of the recording medium; a first curing device which irradiates ultraviolet light for causing the droplets of the ink, deposited on the surface of the recording medium by one of the inkjet heads on an upstream side in a direction of relative conveyance of the recording medium with respect to the inkjet heads, to semi-cure to a degree whereby the droplets of the ink discharged from the inkjet head on the upstream side do not mix on the surface of the recording medium with the droplets of the ink discharged by a next one of the inkjet heads situated on a downstream side in the direction of relative conveyance, the first curing device comprising an ultraviolet light source including a group of light emitting elements arranged in a linear form and disposed between the inkjet heads of the respective colors; and a second curing device which irradiates ultraviolet light for performing main curing of the droplets of the ink on the recording medium to a degree whereby image degradation does not occur upon subsequent handling of the cured droplets of the ink, the second curing device being disposed after one of the inkjet heads situated in a furthest downstream position of the inkjet heads.

According to the present invention, an ultraviolet curable ink having a property whereby it is cured by ultraviolet light is used as the printing ink, and the step of curing this ink is divided into two stages. More specifically, a first curing device (preliminary curing unit) which irradiates ultraviolet light of relatively low energy is provided between the heads of the respective colors, and when the recording medium has passed by the inkjet head section of one color and before it enters into the next head section, ultraviolet light is irradiated by the first curing device and the ink droplets deposited by the preceding head are semi-cured to a degree which prevents mixing with ink droplets of another color deposited by a subsequent head.

The step of depositing an ink of a different color from a subsequent head while the ink droplets deposited by preceding heads are in a semi-cured state is repeated according to the number of ink colors, and when the recording medium has passed the inkjet head of the final color, curing (main fixing) of the ink droplets is performed by irradiating ultraviolet light of relatively high energy required to achieve main curing by the second curing device (main curing unit), to a degree whereby image degradation does not occur during subsequent handling.

Thereby, it is possible to prevent image degradation by bleeding between colors. Furthermore, the irradiation energy of the first curing device provided between the different color heads should be sufficient energy to semi-cure the ink droplets to a degree which prevents color mixing due to interference with ink droplets of a different color, and since this amount of energy is less than that required to perform main curing of the ink droplets, then it has little effect on the inkjet head and it is possible to prevent curing of the ink in the vicinity of the nozzles.

In the present invention, the first curing device comprises ultraviolet light sources, each comprising a group of light emitting elements arranged in the form of a line. More specifically, since the first curing device has low irradiation energy of a level sufficient to semi-cure the ink droplets, then LED elements, LD elements, or the like, can be used for the light emitting elements and hence the first curing device can be achieved at low cost. Furthermore, since the light emission of the group of light emitting elements arranged in a line can be controlled selectively for each individual light emitting element, then the number of light emitting elements that are lit up, and the intensity of the light generated, can be controlled readily.

In the present invention, "handling" means, for example, (1) rubbing of the image surface against the rollers, conveyance guides, and the like, in the conveyance steps downstream of the second curing device, (2) rubbing between prints in the print stacking section, and (3) rubbing of a finished print against various objects when it is actually handled for use. Therefore, the term "main curing" does not necessarily mean that the curing reaction is completed.

In ultraviolet curable inks (UV inks) that have been studied thus far, it is seen that if irradiation of ultraviolet light is halted during the curing reaction and the ink is left in this state without further application of energy, then the curing reaction hardly progresses subsequently. The curing reaction does not restart unless further energy is applied from an external source.

On the other hand, it may also occur that even if ultraviolet energy continues to be applied, polymerization will not occur and some monomer will remain. This is because the ultraviolet light does not penetrate right to the interior of the ink, but it is thought that the remaining monomer can be eliminated if an electron beam is irradiated.

A "full-line recording head (droplet discharging head)" is normally disposed along the direction orthogonal to the relative feed direction (direction of relative movement) of the printing medium, but also possible is an aspect in which the recording head is disposed along the diagonal direction given a predetermined angle with respect to the direction orthogonal to the feed direction. The array form of the nozzles in the recording head is not limited to a single row array in the form of a line, and a matrix array composed of a plurality of rows is also possible. Also possible is an aspect in which a plurality of short-length recording head units having a row of nozzles that do not have lengths that correspond to the entire width of the printing medium are combined, whereby the image-recording element rows are configured so as to correspond to the entire width of the printing medium, with these units acting as a whole.

The "recording medium" is a medium (an object that may be referred to as a print medium, image formation medium, recording medium, image receiving medium, or the like) that receives images recorded by the action of the recording head and includes continuous paper, cut paper, seal paper, OHP sheets, and other resin sheets, as well as film, cloth, printed substrates on which wiring patterns or the like are formed with an inkjet recording apparatus, and various other media without regard to materials or shapes. In the present specification, the term "printing" expresses the concept of not only the formation of characters, but also the formation of images with a broad meaning that includes characters.

The conveyance device for causing the recording medium and the inkjet head to move relatively to each other may include a mode where the recording medium is conveyed with respect to a stationary (fixed) inkjet head, or a mode where an inkjet head is moved with respect to a stationary recording medium (in this case, the first and second curing devices are moved at the same speed as the inkjet head), or a mode where both the inkjet head and the recording medium are moved.

Preferably, the image forming apparatus further comprises a light source control device which controls at least one of a light emission range and a light emission intensity of the group of light emitting elements, in accordance with at least one condition of a range of ink deposited by the inkjet head and a reflectivity of the recording medium.

The device for ascertaining the characteristics of the recording medium, such as the width or reflectivity or the recording medium, is not limited to a device (determination device) that actually measures the width or reflectivity of the recording medium, and it is also possible to adopt a composition in which the type of recording medium used is identified automatically by an ID, or the like, of the supply magazine, and the characteristics of respective recording media are ascertained by referring to a data table arranged according to media types. Furthermore, a composition may also be adopted in which the size, type, or the like, of the recording medium used is input by a user operating a prescribed input device, or the like. The range of the ink deposited by the inkjet heads can be ascertained on the basis of the image data that is to be printed.

By controlling the light emission to the minimum necessary intensity on the basis of the conditions relating to the print, it is possible to reduce effects on the nozzles yet further, and hence the effect of preventing curing of the ink in the vicinity of the nozzle is further enhanced.

Preferably, the first curing device includes a lens which condenses the ultraviolet light emitted from the group of light emitting elements in a linear form in a direction that is substantially perpendicular to the direction of relative conveyance of the recording medium.

A cylindrical lens having a linearly shaped condensing action, or an aspherical lens having a shape that creates diffraction can be used as this lens. By condensing the light irradiated for semi-curing purposes into a line in a direction substantially perpendicular to the direction of relative conveyance of the recording medium, it is possible to restrict the irradiation range and to apply the irradiation energy efficiently, while also being able to prevent reflection of stray light onto the inkjet head.

Preferably, the first curing device comprises a first ultraviolet light source which generates electromagnetic waves including the ultraviolet light; the second curing device comprises a second ultraviolet light source which generates electromagnetic waves including the ultraviolet light; and a wavelength range of the first ultraviolet light source in the first curing device is narrower than a wavelength range of the second ultraviolet light source in the second curing device.

The first curing device which semi-cures the ink droplets without performing main curing can use a light source having a narrower wavelength range than the second curing device for performing main curing.

Preferably, the first curing device comprises a first ultraviolet light source which generates the ultraviolet light; the second curing device comprises a second ultraviolet light source which generates the ultraviolet light; and an intensity of the ultraviolet light irradiated by the first ultraviolet light source in the first curing device is lower than an intensity of the ultraviolet light irradiated by the second ultraviolet light source in the second curing device.

Since the first curing device performs low-energy irradiation which does not reach the energy required for full curing, it is possible to use a light source of lower radiation intensity than the second curing device.

Preferably, the first curing device comprises a first ultraviolet light source which generates the ultraviolet light; the second curing device comprises a second ultraviolet light source which generates the ultraviolet light; and a range of the ultraviolet light irradiated by the first ultraviolet light source in the first curing device is smaller than a range of the ultraviolet light irradiated by the second ultraviolet light source in the second curing device.

It is desirable that the first curing device is composed in such a manner that the irradiation range onto the recording medium is set as narrowly as possible, in order to suppress unwanted reflection of light onto the inkjet head.

In order to attain the aforementioned object, the present invention is also directed to an image forming method for forming color images on a surface of a recording medium by a plurality of full line type inkjet heads separately arranged for a plurality of inks of different colors, each of the inkjet heads having a nozzle row wherein a plurality of nozzles for discharging droplets of the ink are arranged through a length corresponding to a full width of the recording medium, and discharging the droplets of the inks from the plurality of inkjet heads toward the surface of the recording medium, while causing the inkjet heads and the recording medium to move relatively to each other by conveying at least one of the recording medium and the inkjet heads in a direction substantially perpendicular to a breadthways direction of the recording medium, the method comprising the steps of: using ultraviolet curable inks as the inks; during a formation of an image by successive ink discharges of respective colors by the plurality of inkjet heads, performing a first curing process of irradiating ultraviolet light from an ultraviolet light source comprising a group of light emitting elements arranged in a linear form, onto the droplets of the ink deposited on the surface of the recording medium by a preceding one of the inkjet heads before discharge of the droplets of the ink by a subsequent one of the inkjet heads, in such a manner that the droplets of the ink deposited by the preceding inkjet head are semi-cured to a degree whereby the droplets of the ink discharged by the inkjet head of a preceding color in an ink discharge sequence do not mix on the surface of the recording medium with the droplets of the ink of another color discharged by the subsequent inkjet head; and performing a second curing process of irradiating ultraviolet light for performing main curing of the droplets of the ink on the surface of the recording medium after the droplets of the ink have been discharged by a last one of the inkjet heads, to a degree whereby image degradation does not occur upon subsequent handling of the cured droplets of the ink.

In order to achieve the aforementioned objects, the present invention is also directed to an image forming apparatus, comprising: a discharge head having nozzles which discharge droplets of an ink toward a surface of a recording medium; a conveyance device which causes the discharge head and the recording medium to move relatively to each other by conveying at least one of the discharge head and the recording medium; a semiliquid forming curing device which causes the droplets of the ink discharged from the discharge head on a upstream side thereof to cure to a semiliquid state having a viscosity sufficient to prevent color mixing even if the droplets of the ink make contact with droplets of an ink of another color, the semiliquid forming curing device being disposed on a downstream side of the discharge head in a direction of relative conveyance of the recording medium with respect to the discharge head; a flattening device which flattens the droplets of the ink on the surface of the recording medium, the flattening device being disposed on a downstream side of the semiliquid forming curing device; and a main curing device which performs main curing of the droplets of the ink on the surface of the recording medium to a degree whereby image degradation caused by ink smearing does not occur during subsequent conveyance and handling, the main curing device being disposed on a downstream side of the flattening device.

According to the present invention, a semiliquid forming curing device and a main curing device are provided as devices for curing the ink discharged by the discharge head, and the ink is cured in a stepwise fashion by means of these two curing devices. Therefore, the progress of curing is controlled. Immediately after ink discharge by the discharge head, the ink is cured to a semiliquid state (a semi-hardened state which is not completely hardened, or a high-viscosity state) by means of the semiliquid forming curing device downstream of the discharge head. Since the ink in the semiliquid state is relatively flexible and can be deformed readily, then the flattening device is caused to act on the ink while it is in the semiliquid state and thus undulations in the ink surface are flattened. When the flattening process has completed, the ink is cured and fixed by the main curing device to a degree whereby image degradation does not occur due to ink smearing, or the like, during subsequent handling. Thereby, it is possible to flatten the ink surface reliably and therefore uneven surface feel caused by differences in the amount of overlap between ink droplets can be eliminated. Furthermore, since flattening (surface leveling) can be performed while the ink is in a flexible state before main curing, it is possible to prevent cracking and peeling of the ink surface during a flattening process based on pressurization.

In the present invention, "handling" means, for example, (1) rubbing of the image surface against the rollers, conveyance guides, and the like, in the conveyance steps downstream of the main curing device, (2) rubbing between prints in the print stacking section, and (3) rubbing of a finished print against various objects when it is actually handled for use. Therefore, "main curing" does not necessarily mean that the curing reaction is fully completed.

Furthermore, when forming a color image, desirably, an ink discharge process and a semiliquid forming process are repeated for each color, using inks of a plurality of colors, and a flattening process is performed after the semiliquid forming process of the last color. According to this mode, since ink of a subsequent color is ejected when the ink of the previously ejected color or colors is in the semiliquid state, then there is no color mixing when inks of different colors overlap with each other, and therefore image degradation due to color bleeding can be prevented. Furthermore, since the ink discharged onto the recording medium is changed to a semiliquid state in a short period of time by the semiliquid forming curing device, a further beneficial effect is obtained in that bleeding is prevented even in the case of a highly permeable recording medium.

In the present invention, it is possible to use an ink that is curable by application of energy, such as an ultraviolet curable ink, or a phase change ink, such as a solid ink, as the printing ink. An ink that is curable by application of energy is an ink having a property whereby it hardens when applied with energy from electromagnetic waves, including visible light or ultraviolet light, X rays, an electron beam, or the like. The progress of curing (hardening) is controlled by applying the energy in steps, using a semiliquid forming curing device and a main curing device.

Solid ink has properties whereby it is solid at normal temperature and reduces in viscosity when it is heated. Therefore, when using a solid ink, a heating device is used as the semiliquid forming curing device and a cooling device is used as the main curing device.

A compositional example of a discharge head is a full line type inkjet head having a nozzle row in which a plurality of nozzles for discharging ink are arranged through a length corresponding to the full width of the recording medium. If forming a color image, full line ink jet heads relating respectively to one of a plurality of colors are installed.

Preferably, the flattening device comprises a pressurizing device which applies pressure to the droplets of the ink on the surface of the recording medium.

Preferably, the flattening device further comprises a heating device which heats the droplets of the ink on the surface of the recording medium.

It is possible to carry out flattening by means of a pressurizing device which applies pressure to the ink, only, without using a heating device. Furthermore, by adopting a composition which combines a heating device and a pressurizing device, it is possible to carry out flattening more efficiently in accordance with the type of ink and recording medium. For example, if the ink used is of a type which proceeds to cure when applied with heat, then it is possible to promote a curing reaction while performing the flattening process, and hence the energy applied by the main curing device can be reduced.

For example, the image forming apparatus further comprises an ink supply device which supplies ink that is curable by application of energy to the discharge head.

If ink that is curable by application of energy is used as the printing ink, then relatively low energy which does not reach a level required for main curing is applied by the semiliquid forming curing device, and the ink is thus cured to a semiliquid state of a level which maintains sufficient viscosity to prevent color mixing, even if the ink makes contact with an ink of another color in a liquid state. Subsequently, relatively high energy sufficient for main curing is applied by the main curing device after the flattening process, thereby curing and fixing the ink.

Preferably, a plurality of the discharge head are provided for inks of a plurality of colors, the plurality of discharge heads being disposed from an upstream side in order of ascending curing sensitivity of the inks upon application of energy; and a plurality of the semiliquid forming curing device are disposed on downstream sides of the plurality of discharge heads.

One mode of a device composition for forming a color image using inks of a plurality of colors is a mode in which discharge heads are provided separately for each color. Since the inks have different energy absorption efficiency, and the like, the curing sensitivity varies depending on the color of the ink. Therefore, by adopting a composition as described in claim 12, in which the discharge heads are arranged in order of ascending curing sensitivity of the ink color, from the upstream side toward the downstream side, and semiliquid forming curing devices are disposed respectively downstream of each discharge head, then the lower the curing sensitivity of the ink, the greater the number of times it passes through a treatment region of a semiliquid forming curing device.

Therefore, as the image forming process by the discharge heads of respective colors progresses successively, curing of the ink is promoted in accordance with the number of times that the ink passes through a treatment region of a semiliquid forming curing device, and hence any differences between the liquid states (semiliquid states) of the respective colors can be equalized by the time of the flattening process by the flattening device disposed after the last semiliquid forming curing device.

Preferably, the image forming apparatus further comprises a control device which controls at least one of flattening conditions of the flattening device and the energy applied by the semiliquid forming curing device in accordance with at least one condition of a type of recording medium, a type of ink and an amount of ink deposited.

The type of recording medium can be identified in terms of the material, size, thickness, reflectivity, adhesion characteristics, permeability, or the like. The device which ascertains the type of recording medium is not limited to a device that actually measures the width or reflectivity of the recording medium, and it is also possible to adopt a composition in which the type of recording medium used is identified automatically, and the characteristics of respective recording media are ascertained by referring to a data table arranged according to media types. Furthermore, a composition may also be adopted in which the type or thickness of the recording medium used is input by a user operating a prescribed input device, or the like.

For the device which acquires information on the ink type, it is possible to use, for example, a device which reads in ink properties information from the shape of the cartridge in the ink tank (a specific shape which allows the ink type to be identified), or from a bar code or IC chip incorporated into the cartridge. Besides this, it is also possible to adopt a composition in which the required information is input by an operator, using a prescribed input device (user interface).

The amount of ink deposited can be ascertained from information relating to the ink discharge volume, on the basis of the image data that is to be printed. By controlling conditions in such a manner that a suitable flattening process and/or semiliquid forming process are performed on the basis of the conditions relating to the print, it is possible to prevent peeling and cracking of the ink that occurs in the event of excessive flattening, and hence even more suitable image fixing can be achieved.

For example, the image forming apparatus further comprises: a phase change ink supply device which supplies a phase change ink to the discharge head, wherein: the discharge head discharges the phase change ink in a high-temperature molten state; and the main curing device performs main curing of the phase change ink by cooling.

When using a phase change ink, the ink is maintained in a high-temperature molten state inside the discharge head, and is discharged as liquid droplets from the nozzles. The semiliquid forming curing device applies heat to the ink that is sufficient to maintain the phase change ink which has been discharged from the discharge head in the semiliquid state. The main curing device cools the ink on the recording medium in such a manner that the ink in the semiliquid state is cured and fixed to a degree which prevents image degradation due to ink smearing, or the like, during subsequent conveyance and handling.

Preferably, the image forming apparatus further comprises a discharge head which discharges a clear ink arranged after the discharge heads which discharge colored ink.

Desirably, a mode is adopted in which a discharge head which discharges clear ink for the purpose of surface leveling is provided after the discharge heads which discharge colored ink required for printing a color image, droplets of clear ink are deposited onto areas of the recording medium where no colored ink droplets have been deposited or where relatively few colored ink droplets have been deposited in comparison with other regions, thereby causing the amount of ink deposited at each printing point to be approximately uniform, whereupon a flattening process is carried out by the flattening device.

Preferably, the image forming apparatus further comprises a withdrawal drive mechanism which moves the flattening device from a prescribed flattening process position to a prescribed withdrawal position.

The flattening device is constructed so as to be movable, and if ink flattening (application of a glossy finish) is not required, then the flattening device is moved to the withdrawal position and the flattening process is omitted. Thereby, the ink is cured and fixed by the main curing device, while the ink surface still contains undulations. In this way, a desirable composition is one in which the flattening device can selected to be used or not to be used, depending on requirements.

In order to attain the aforementioned object, the present invention is also directed to an image forming method for forming images on a surface of a recording medium by discharging ink from a discharge head having nozzles for discharging droplets of the ink toward the surface of the recording medium and causing the discharge head and the recording medium to move relatively to each other by conveying at least one of the discharge head and the recording medium, the method comprising: a discharge step of discharging droplets of one of an ink curable by application of energy and a phase change ink onto the recording medium by means of the discharge head; a semiliquid forming curing step of causing the droplets of the ink discharged in the discharge step to cure to a semiliquid state having a viscosity sufficient to prevent color mixing even if the droplets of the ink make contact with droplets of an ink of another color on the surface of the recording medium; a flattening step of flattening the droplets of the ink by applying pressure to the droplets of the ink in the semiliquid state on the surface of the recording medium; and a main curing step of performing main curing of the droplets of the ink on the surface of the recording medium, after the flattening step, to a degree whereby image degradation caused by ink smearing does not occur during subsequent conveyance and handling.

According to the present invention, since an ultraviolet curable ink is used as the printing ink, and first curing devices which irradiate ultraviolet light of relatively low energy sufficient to semi-cure the ink are provided between the inkjet heads of respective colors, while a second curing device which irradiates ultraviolet light of sufficient energy to perform main curing of the ink the ink is provided after the inkjet head of the last color, then it is possible to prevent image degradation caused by bleeding between colors, and furthermore, it is possible to prevent curing of the ink in the vicinity of the nozzles.

According to the present invention, since the ink is cured to a semiliquid state by semiliquid forming curing devices disposed downstream of the discharge heads, whereupon a process of flattening the undulations in the ink is carried out while the ink is in the semiliquid state, and main curing of the ink is then performed by a main curing device, it is possible to eliminate uneven feel in the surface caused by variation in the amount of overlap between ink droplets. Furthermore, since flattening (surface leveling) can be performed while the ink is in a flexible state before main curing, it is possible to prevent cracking and peeling of the ink during a flattening process based on pressurization.

Moreover, in the present invention, when forming a color image by using inks of a plurality of colors, it is possible to prevent image degradation due to color bleeding, by printing inks of subsequent colors, successively, in an overlapping fashion, while the inks of previously discharged colors are in the semiliquid state.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIGS. 12A and 12B are diagrams showing a further composition of a light source section used in a preliminary curing light source, wherein FIG. 12A is a front view and FIG. 12B is a side view;

FIGS. 13A and 13B are diagrams showing a further composition of a light source section used in a preliminary curing light source, wherein FIG. 13A is a front view and FIG. 13B is a side view;

DETAILED DESCRIPTION OF THE PREFERRED EMBODIMENTS

Figure 1:
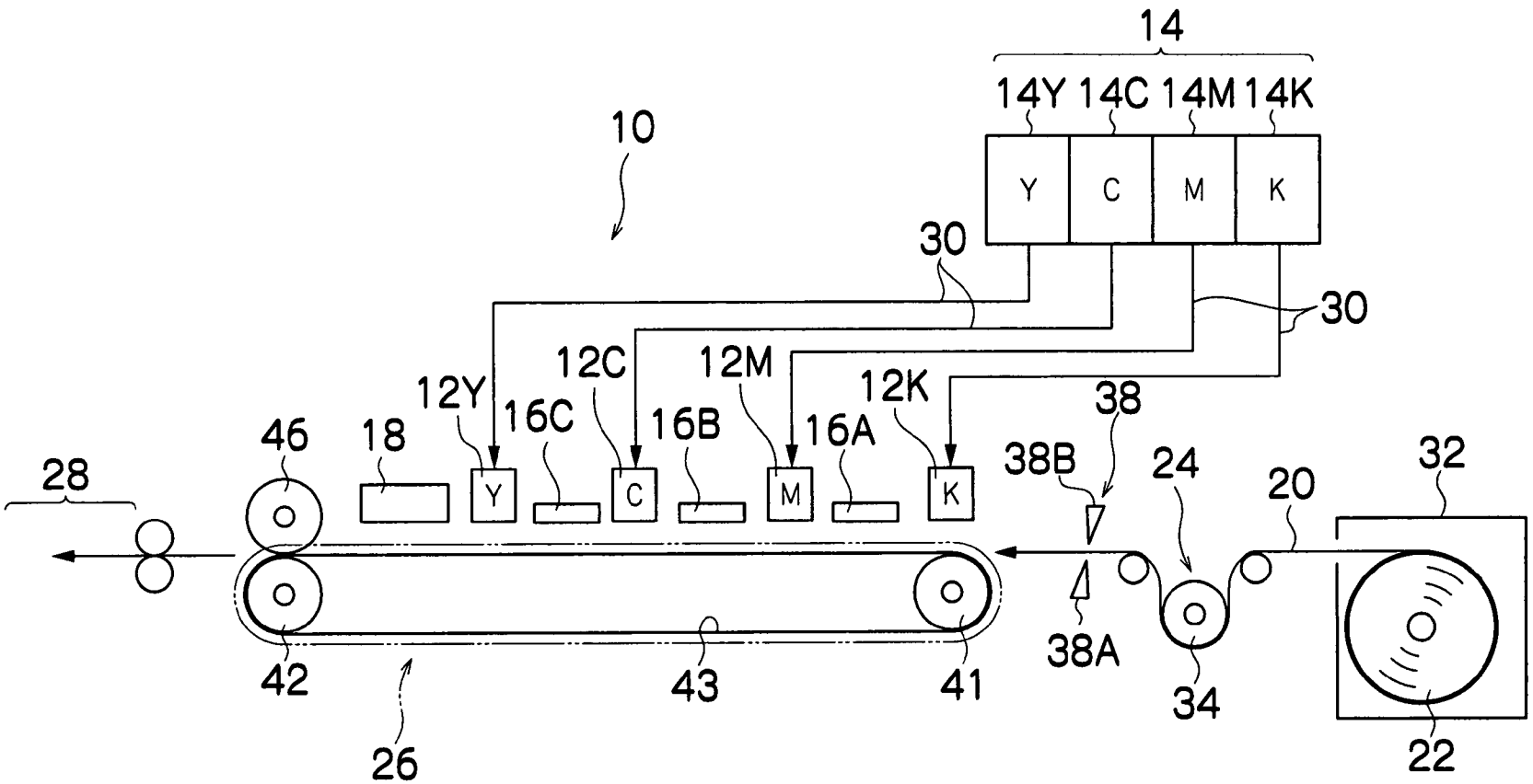
FIG. 1 is a general schematic drawing of an inkjet recording apparatus according to first embodiment of the present invention.

FIG. 1 is a general schematic drawing of an inkjet recording apparatus according to first embodiment of the present invention. As shown in FIG. 1, the image forming apparatus 10 comprises: a printing unit 12 having a plurality of print heads 12K, 12C, 12M, and 12Y for ink colors of black (K), cyan (C), magenta (M), and yellow (Y), respectively; an ink storing and loading unit 14 for storing ultraviolet curable inks (i.e., UV inks) of K, C, M and Y to be supplied to the print heads 12K, 12C, 12M, and 12Y; a plurality of preliminary curing light sources 16A, 16B, and 16C disposed between the print heads 12K, 12C, 12M, and 12Y; a main curing light source 18 disposed downstream of the ending print head 12Y; a paper supply unit 22 for supplying recording paper 20 as the recording medium; a decurling unit 24 for removing curl in the recording paper 20; a suction belt conveyance unit 26 disposed facing the nozzle face (ink-droplet discharged face) of the print unit 12 and optical radiation face of the other light sources (16A, 16B, 16C, and 18) or conveying the recording paper 20 while keeping the recording paper 20 flat; and a paper output unit 28 for outputting image-printed recording paper (printed matter) to the exterior.

Ultraviolet curable ink is an ink containing a component which hardens (polymerizes) upon application of ultraviolet energy (namely, an ultraviolet curable component, such as a monomer, oligomer, or a low-molecular-weight homopolymer, copolymer, or the like), and a polymerization initiator. The ink therefore has a property whereby, when the ink is irradiated with ultraviolet light, it starts to polymerize and as the polymerization progress, the viscosity of the ink increases and finally it hardens.

The ink storing and loading unit 14 has tanks for storing the inks of K, C, M and Y to be supplied to the print heads 12K, 12C, 12M, and 12Y, and the tanks are connected to the print heads 12K, 12C, 12M, and 12Y through channels (not shown), respectively. The ink storing and loading unit 14 has a warning device (e.g., a display device, an alarm sound generator) for warning when the remaining amount of any ink is low, and has a mechanism for preventing loading errors among the colors.

In FIG. 1, a single magazine for rolled paper (continuous paper) is shown as an example of the paper supply unit 22; however, a plurality of magazines 32 with paper differences such as paper width and quality may be jointly provided. Moreover, paper may be supplied with a cassette that contains cut paper loaded in layers and that is used jointly or in lieu of a magazine for rolled paper.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 20 delivered from the paper supply unit 22 retains curl due to having been loaded in the magazine 32. In order to remove the curl, heat is applied to the recording paper 20 in the decurling unit 24 by a heating drum 34 in the direction opposite from the curl direction in the magazine 32. The heating temperature at this time is preferably controlled so that the recording paper 20 has a curl in which the surface on which the print is to be made is slightly round outward.

In the case of the configuration in which roll paper is used, a cutter (first cutter) 38 is provided as shown in FIG. 1, and the continuous paper is cut into a desired size by the cutter 38. The cutter 38 has a stationary blade 38A, whose length is not less than the width of the conveyor pathway of the recording paper 20, and a round blade 38B, which moves along the stationary blade 38A. The stationary blade 38A is disposed on the reverse side of the printed surface of the recording paper 20, and the round blade 38B is disposed on the printed surface side across the conveyor pathway. When cut paper is used, the cutter 38 is not required.

The decurled and cut recording paper 20 is delivered to the suction belt conveyance unit 26. The suction belt conveyance unit 26 has a configuration in which an endless belt 43 is set around rollers 41 and 42 so that the portion of the endless belt 43 facing at least the nozzle face of the printing unit 12 forms a horizontal plane (flat plane).

The belt 43 has a width that is greater than the width of the recording paper 20, and a plurality of suction apertures (not shown) are formed on the belt surface. A suction chamber (not shown) is disposed on the interior side of the belt 33, which is set around the rollers 41 and 42, as shown in FIG. 1; and the suction chamber provides suction with a fan (not shown) to generate a negative pressure, and the recording paper 20 is held on the belt 43 by suction.

The belt 43 is driven in the counterclockwise direction in FIG. 1 by the motive force of a motor (not shown in FIG. 1, but shown as a motor 134 in FIG. 14) being transmitted to at least one of the rollers 41 and 42, which the belt 43 is set around, and the recording paper 20 held on the belt 43 is conveyed from right to left in FIG. 1.

Each of the print heads 12K, 12C, 12M, and 12Y is composed of a full-line head which has a length that corresponds to the maximum paper width intended for use in the image forming apparatus 10, and in which a plurality of ink-droplet ejection apertures (nozzles) are arranged along a length that exceeds at least one side of the maximum-size recording paper 20 (i.e. along the entire width of the printable area).

The print heads 12K, 12C, 12M, and 12Y are arranged in this order from the upstream side along the direction perpendicular to the delivering direction of the recording paper 20 (hereinafter referred to as the paper conveyance direction). A color print can be formed on the recording paper 20 by ejecting the inks from the print heads 12K, 12C, 12M, and 12Y, respectively, onto the recording paper 20 while conveying the recording paper 20.

The print unit 12, in which the full-line heads covering the entire width of the paper are thus provided for the respective ink colors, can record an image over the entire surface of the recording paper 20 by performing the action of moving the recording paper 20 and the print unit 12 relatively to each other in the sub-scanning direction just once (i.e., with a single sub-scan). Higher-speed printing is thereby made possible and productivity can be improved in comparison with a shuttle type head configuration in which a print head reciprocates in the main scanning direction.

Although the configuration with the KCMY four standard colors is described in the present embodiment, combinations of the ink colors and the number of colors are not limited to those, and light and/or dark inks can be added as required. For example, a configuration is possible in which print heads for ejecting light-colored inks such as light cyan and light magenta are added. The arrangement order of the heads of colors is not particularly limited.

The preliminary curing light sources 16A, 16B and 16C disposed between the print heads have a length corresponding to the maximum width of the recording paper 20, similarly to the heads, and they are fixed extending in a direction substantially perpendicular to the conveyance direction of the recording paper 20. The preliminary curing light sources 16A, 16B and 16C irradiate ultraviolet light having an energy of a level whereby the ink droplets deposited by the print head 12K, 12M or 12C situated adjacently on the upstream side of the irradiating unit is changed to a semi-hardened state (a state where it is not completely hardened, or a semiliquid state).

In other words, the preliminary curing light sources 16 have the function of semi-curing the ink droplets on the recording paper 20 in order to prevent intermixing of inks, in such a manner that ink droplets deposited onto the recording paper 20 by a preceding print head 12K, 12M or 12C do not mix on the recording paper with ink droplets of another color ejected from a subsequent print head 12M, 12C or 12Y, and thus preventing the occurrence of color bleeding.

When the recording paper 20 has passed under an upstream print head unit and before it passes below the next print head, light is irradiated from the preliminary curing light source 16, thereby changing the ink on the recording paper 20 to a semi-cured state, in such a manner that droplets of a different color can be deposited by the subsequent print head.

In the example shown in FIG. 1, after droplets have been ejected by the black head 12K, they are passed through the light irradiated by the preliminary curing light source 16A, and the droplets of black ink are thereby changed to a semi-cured state, whereupon droplets are ejected by the magenta head 12M. Similarly, after ejection of droplets by the magenta head 12M, the droplets pass through light irradiated by the preliminary curing light source 16B, whereupon droplets are ejected by the cyan head 12C, passed through the light irradiated by the preliminary curing light source 16C, and then droplets are ejected by the yellow head 12Y.

After ejection of droplets by the yellow head 12Y, which is the last color, it is not necessary to perform light irradiation in order to semi-cure the ink, and therefore no preliminary curing light source is provided.

After passing the yellow head 12Y, light of a sufficient amount to cure (fully cure) the ink droplets on the recording paper 20 is irradiated by the main curing light source 18, thereby perform main curing in such a manner that no deterioration of the image is caused by subsequent handling (in downstream stages).

A pressurizing and fixing roller 46 is provided on the downstream side of the main curing light source 18. The pressurizing and fixing roller 46 is a device for controlling the glossiness and evenness of the image surface.

The printed object generated in this manner is output via the paper output unit 28. Although not shown in FIG. 1, the paper output unit 28 is provided with a sorter for collecting images according to print orders.

Structure of Print Head

Next, the structure of the print heads is described. The print heads 12K, 12C, 12M and 12Y have the same structure, and a reference numeral 50 is hereinafter designated to any of the print heads 12K, 12C, 12M and 12Y.

Figure 2A:
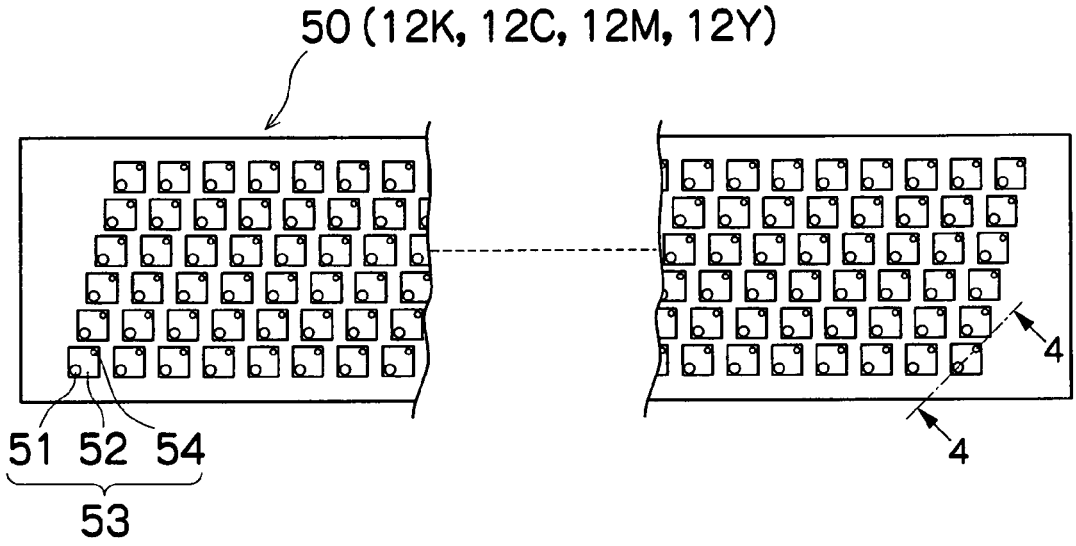
FIG. 2A is a perspective plan view showing an example of the configuration of the print head 50.
Figure 2B:
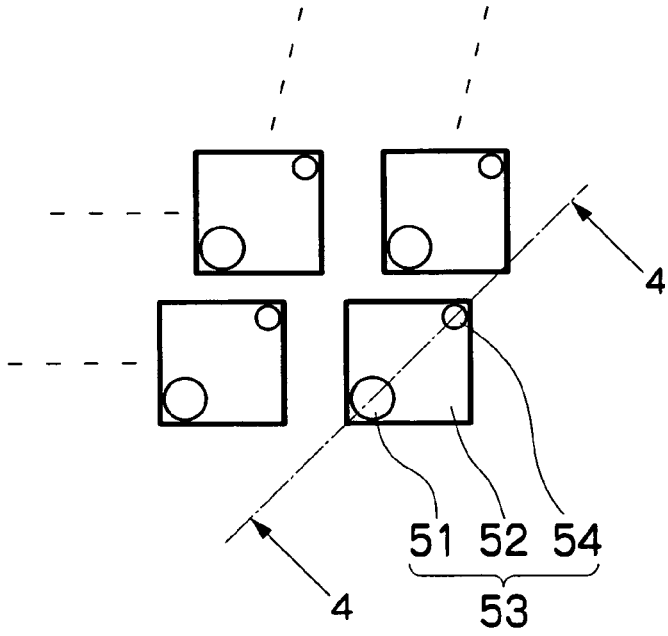
FIG. 2B is an enlarged view of a portion thereof.
Figure 3:
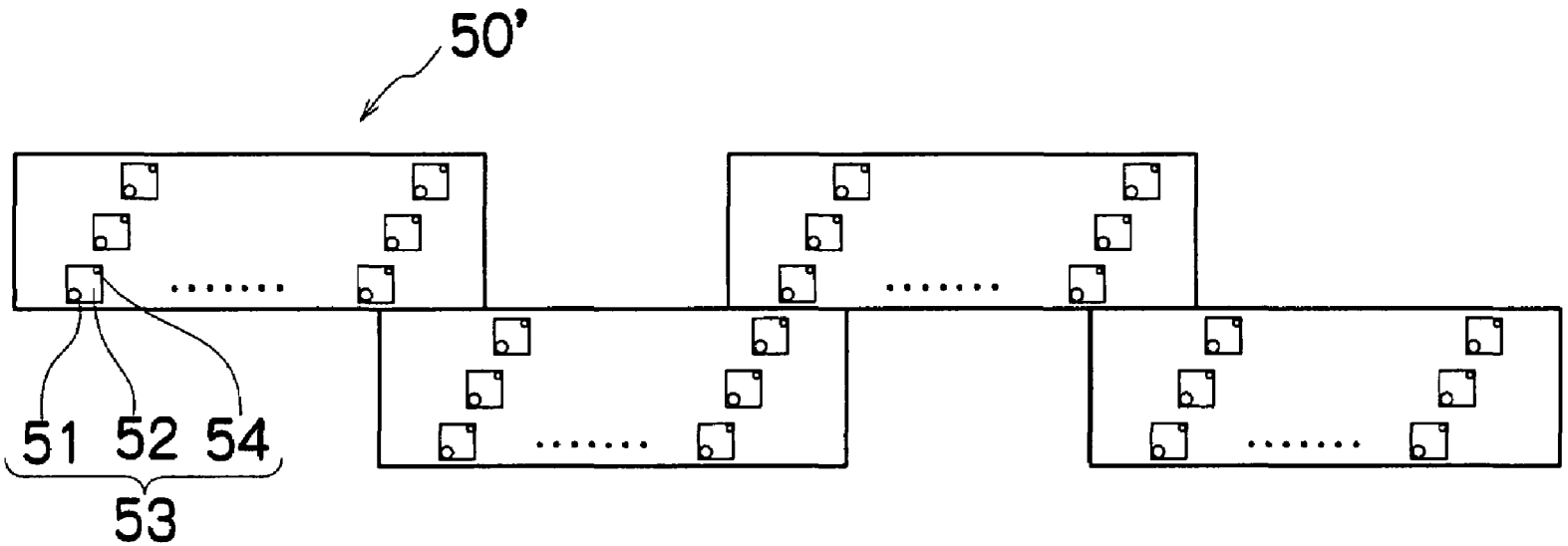
FIG. 3 is a perspective plan view showing another example of the configuration of the print head.
Figure 4:
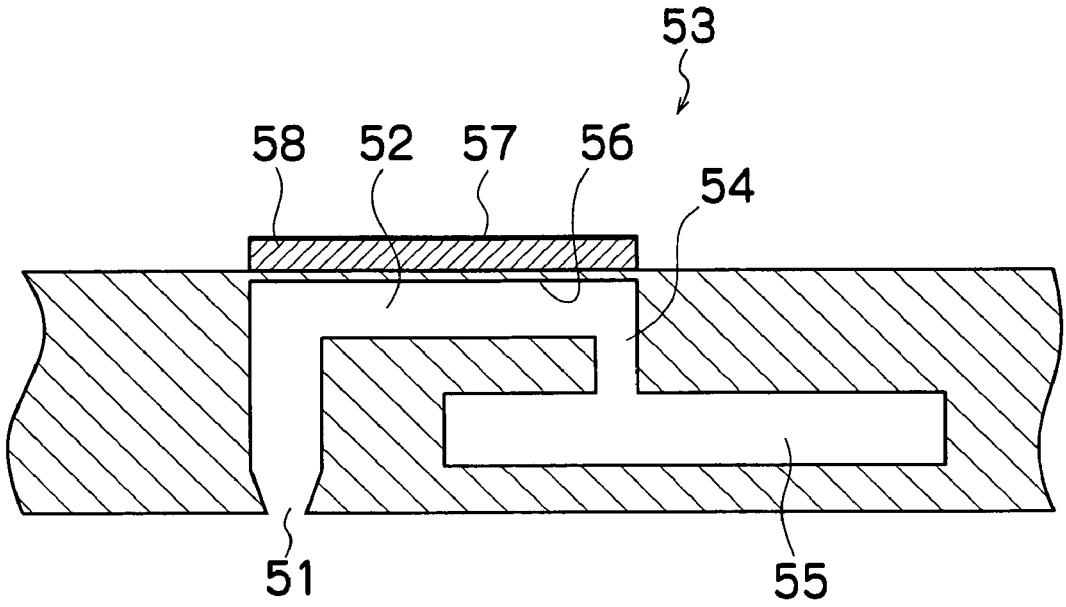
FIG. 4 is a cross-sectional view taken along the line 4-4 in FIGS. 2A and 2B.

FIG. 2A is a perspective plan view showing an example of the configuration of the print head 50, FIG. 2B is an enlarged view of a portion thereof, FIG. 3 is a perspective plan view showing another example of the configuration of the print head, and FIG. 4 is a cross-sectional view taken along the line 4-4 in FIGS. 2A and 2B, showing the inner structure of an ink chamber unit corresponding to a nozzle 51.

The nozzle pitch in the print head 50 should be minimized in order to maximize the density of the dots printed on the surface of the recording paper 20. As shown in FIGS. 2A, and 2B, the print head 50 in the present embodiment has a structure in which a plurality of ink chamber units (droplets discharge elements) 53 including nozzles 51 for ejecting ink-droplets and pressure chambers 52 connecting to the nozzles 51 are disposed in the form of a staggered matrix, and the effective nozzle pitch is thereby made small.

Thus, as shown in FIGS. 2A and 2B, the print head 50 in the present embodiment is a full-line head in which one or more of nozzle rows in which the ink discharging nozzles 51 are arranged along a length corresponding to the entire width of the recording medium in the direction substantially perpendicular to the conveyance direction of the recording medium. However, the arrangement of the nozzle rows in the present embodiment is limited to those. Alternatively, as shown in FIG. 3, a full-line head can be composed of a plurality of short two-dimensionally arrayed head units 50' arranged in the form of a staggered matrix and combined so as to form nozzle rows having lengths that correspond to the entire width of the recording paper 20.

As shown in FIGS. 2A and 2B, the planar shape of the pressure chamber 52 provided for each nozzle 51 is substantially a square, and an outlet to the nozzle 51 and an inlet for supplied ink (supply port) 54 are disposed in both corners on a diagonal line of the square. The shape of the pressure chamber 52 is not limited to the present example, and the planar shape may one of various shapes, such as a quadrilateral shape (diamond, rectangle, or the like), another polygonal shape, such as a pentagon or hexagon, or a circular or elliptical shape.

As shown in FIG. 4, each pressure chamber 52 is connected to a common channel 55 through the supply port 54. The common channel 55 is connected to an ink supply tank 60 (not shown in FIG. 4, but shown as a reference numeral 60 in FIG. 6), which is a base tank that supplies ink, and the ink supplied from the ink supply tank 60 is delivered through the common flow channel 55 to the pressure chamber 52.

An actuator 58 provided with an individual electrode 57 is bonded to a pressure plate (diaphragm) 56, which forms a part (the upper face in FIG. 4) of the pressure chamber 52. When a drive voltage is applied to the individual electrode 57, the actuator 58 is deformed, the volume of the pressure chamber 52 is thereby changed, and the pressure in the pressure chamber 52 is thereby changed, so that the ink inside the pressure chamber 52 is thus ejected through the nozzle 51. The actuator 58 is preferably a piezoelectric element. When ink is ejected, new ink is supplied to the pressure chamber 52 from the common flow channel 55 through the supply port 54.

Figure 5:
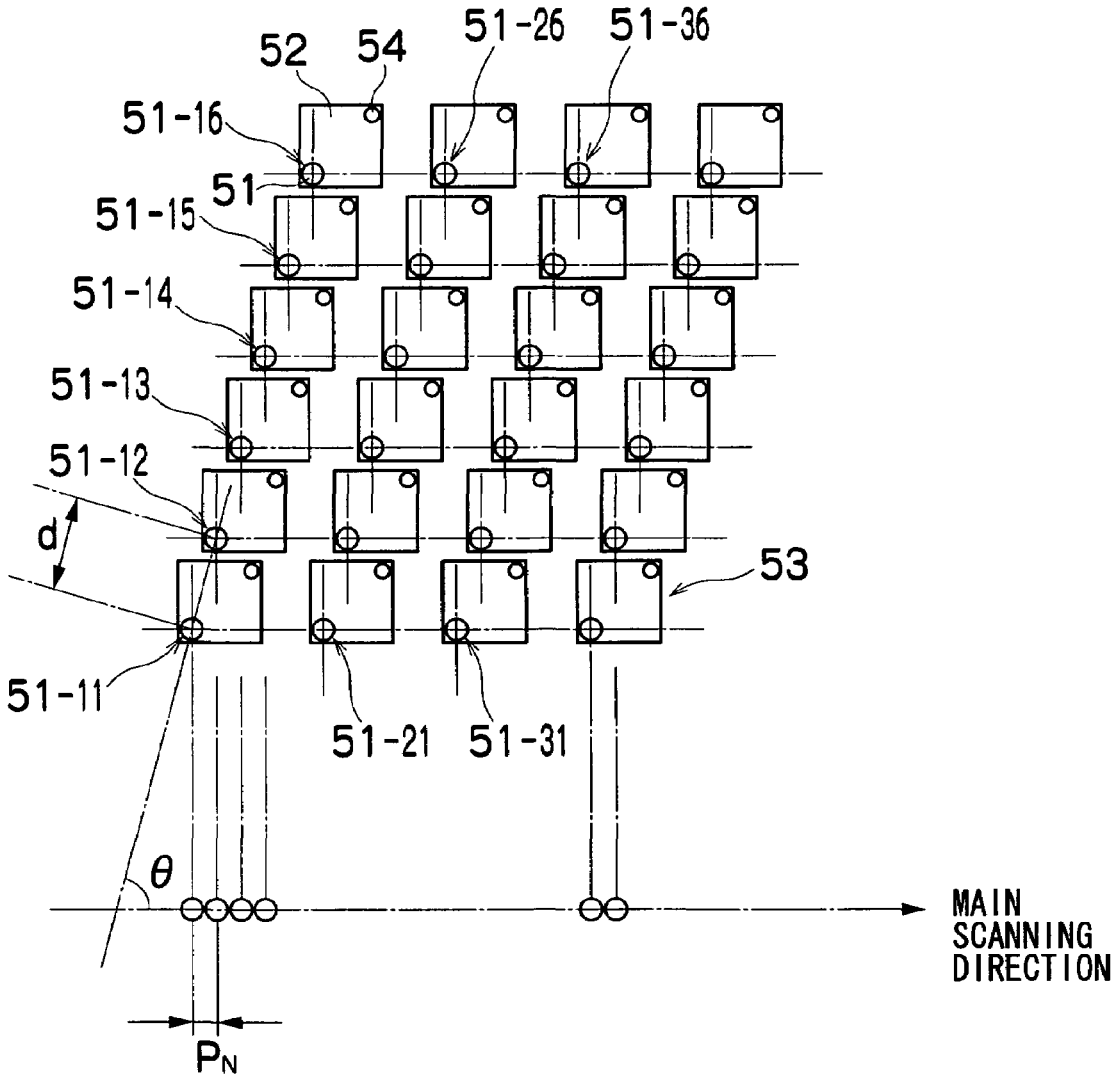
FIG. 5 is an enlarged view showing a nozzle arrangement in the print head illustrated in FIGS. 2A and 2B.

The plurality of ink chamber units 53 having such a structure are arranged in a grid with a fixed pattern in the line-printing direction along the main scanning direction and in the diagonal-row direction forming a fixed angle θ that is not a right angle with the main scanning direction, as shown in FIG. 5. With the structure in which the plurality of rows of ink chamber units 53 are arranged at a fixed pitch d in the direction at the angle θ with respect to the main scanning direction, the nozzle pitch $P_N$ as projected in the main scanning direction is d×cos θ.

Hence, the nozzles 51 can be regarded to be equivalent to those arranged at a fixed pitch $P_N$ on a straight line along the main scanning direction. Such configuration results in a nozzle structure in which the nozzle row projected in the main scanning direction has a high nozzle density of up to 2,400 nozzles per inch (npi).

In a full-line head comprising rows of nozzles that have a length corresponding to the entire width of the paper (the recording paper 20), the "main scanning" is defined as to print one line (a line formed of a row of dots, or a line formed of a plurality of rows of dots) in the width direction of the recording paper (the direction perpendicular to the delivering direction of the recording paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other.

In particular, when the nozzles 51 arranged in a matrix such as that shown in FIG. 5 are driven, the main scanning according to the above-described (3) is preferred. More specifically, the nozzles 51-11, 51-12, 51-13, 51-14, 51-15 and 51-16 are treated as a block (additionally; the nozzles 51-21, 51-22, . . . , 51-26 are treated as another block; the nozzles 51-31, 51-32, . . . , 51-36 are treated as another block, . . . ); and one line is printed in the width direction of the recording paper 20 by sequentially driving the nozzles 51-11, 51-12, . . . , 51-16 in accordance with the conveyance velocity of the recording paper 20.

On the other hand, the "sub-scanning" is defined as to repeatedly perform printing of one line (a line formed of a row of dots, or a line formed of a plurality of rows of dots) formed by the main scanning, while moving the full-line head and the recording paper relatively to each other.

The "main scanning direction" is described as the direction of one line recorded by the above-described main scanning, the "sub-scanning direction" is described as the direction performing the above-described sub-scanning. More specifically, in the present embodiment, the delivering direction of the recording paper 20 is the sub-scanning direction, and the direction perpendicular to the sub-scanning direction is the main scanning direction.

In implementing the present invention, the arrangement of the nozzles is not limited to that of the example illustrated. Moreover, a method is employed in the present embodiment where an ink droplet is ejected by means of the deformation of the actuator 58, which is typically a piezoelectric element; however, in implementing the present invention, the method used for discharging ink is not limited in particular, and instead of the piezo jet method, it is also possible to apply various types of methods, such as a thermal jet method where the ink is heated and bubbles are caused to form therein by means of a heat generating body such as a heater, ink droplets being ejected by means of the pressure of these bubbles.

Configuration of Ink Supply System

Figure 6:
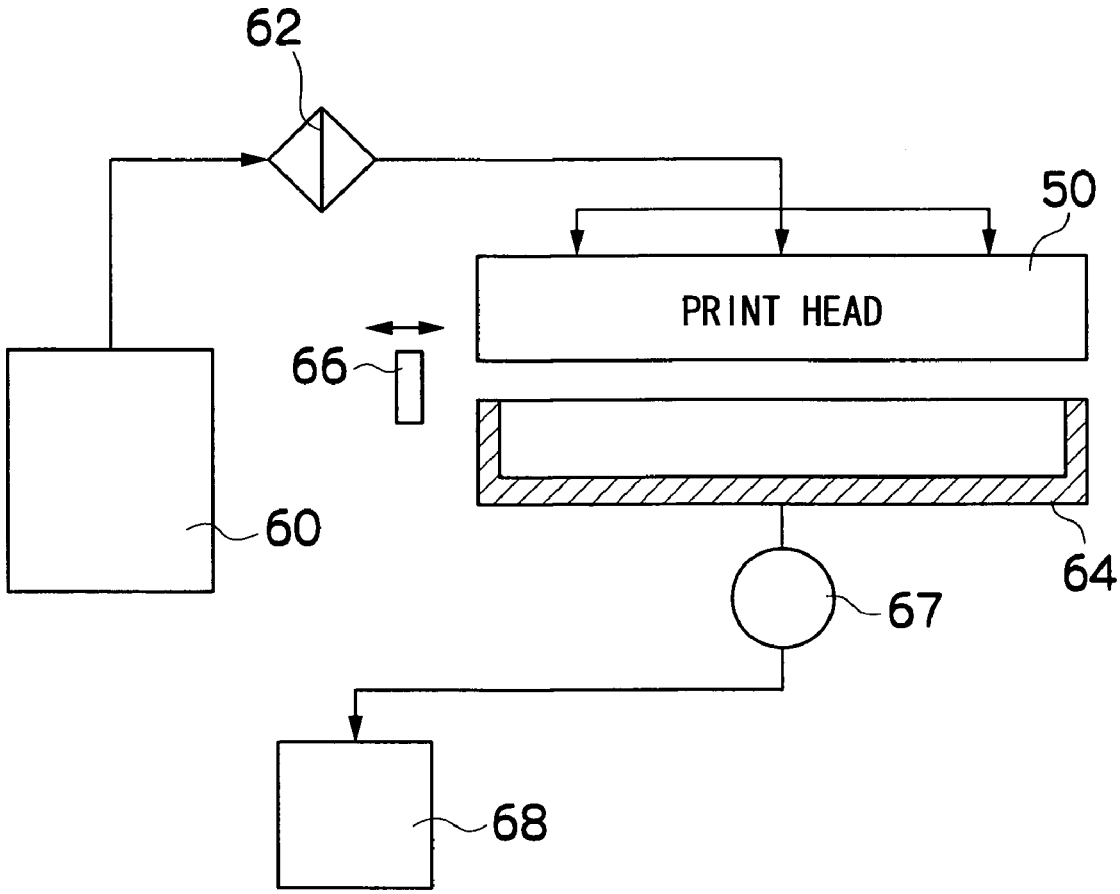
FIG. 6 is a schematic drawing showing the composition of an ink supply system in an image forming apparatus.

FIG. 6 is a schematic drawing showing the configuration of the ink supply system in the image forming apparatus 10. An ink supply tank 60 is a base tank that supplies ink and is set in the ink storing and loading unit 14 described with reference to FIG. 1. The aspects of the ink supply tank 60 include a refillable type and a cartridge type: when the remaining amount of ink is low, the ink supply tank 60 of the refillable type is filled with ink through a filling port (not shown) and the ink supply tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type. The ink supply tank 60 in FIG. 6 is equivalent to the ink storing and loading unit 14 in FIG. 1 described above.

A filter 62 for removing foreign matters and bubbles is disposed between the ink supply tank 60 and the print head 50 as shown in FIG. 6. The filter mesh size in the filter 62 is preferably equivalent to or less than the diameter of the nozzle and commonly about 20 μm. Although not shown in FIG. 6, it is preferable to provide a sub-tank integrally to the print head 50 or nearby the print head 50. The sub-tank has a damper function for preventing variation in the internal pressure of the head and a function for improving refilling of the print head.

The image forming apparatus 10 is also provided with a cap 64 as a device to prevent the nozzles 51 from drying out or to prevent an increase in the ink viscosity in the vicinity of the nozzles 51, and a cleaning blade 66 as a device to clean the nozzle face. A maintenance unit including the cap 64 and the cleaning blade 66 can be moved in a relative fashion with respect to the print head 50 by a movement mechanism (not shown), and is moved from a predetermined holding position to a maintenance position below the print head 50 as required.

The cap 64 is displaced up and down in a relative fashion with respect to the print head 50 by an elevator mechanism (not shown). When the power of the image forming apparatus 10 is switched OFF or when in a print standby state, the cap 64 is raised to a predetermined elevated position so as to come into close contact with the print head 50, and the nozzle face is thereby covered with the cap 64.

The cleaning blade 66 is composed of rubber or another elastic member, and can slide on the ink discharge surface (surface of the nozzle plate) of the print head 50 by means of a blade movement mechanism (not shown). When ink droplets or foreign matter has adhered to the nozzle plate, the surface of the nozzle plate is wiped, and the surface of the nozzle plate is cleaned by sliding the cleaning blade 66 on the nozzle plate.

During printing or standby, when the frequency of use of specific nozzles is reduced and ink viscosity increases in the vicinity of the nozzles, a preliminary discharge is made toward the cap 64 to discharge the degraded ink.

Also, when bubbles have become intermixed in the ink inside the print head 50 (inside the pressure chamber), the cap 64 is placed on the print head 50, ink (ink in which bubbles have become intermixed) inside the pressure chamber is removed by suction with a suction pump 67, and the suction-removed ink is sent to a collection tank 68. This suction action entails the suctioning of degraded ink whose viscosity has increased (hardened) when initially loaded into the head, or when service has started after a long period of being stopped.

When a state in which ink is not discharged from the print head 50 continues for a certain amount of time or longer, the ink solvent in the vicinity of the nozzles 51 evaporates and ink viscosity increases. In such a state, ink can no longer be discharged from the nozzle 51 even if the actuator 58 is operated. Before reaching such a state the actuator 58 is operated (in a viscosity range that allows discharge by the operation of the actuator 58), and the preliminary discharge is made toward the ink receptor to which the ink whose viscosity has increased in the vicinity of the nozzle is to be discharged. After the nozzle surface is cleaned by a wiper such as the cleaning blade 66 provided as the cleaning device for the nozzle face, a preliminary discharge is also carried out in order to prevent the foreign matter from becoming mixed inside the nozzles 51 by the wiper sliding operation. The preliminary discharge is also referred to as "dummy discharge", "purge", "liquid discharge", and so on.

When bubbles have become intermixed in the nozzle 51 or the pressure chamber 52, or when the ink viscosity inside the nozzle 51 has increased over a certain level, ink can no longer be discharged by the preliminary discharge, and a suctioning action is carried out as follows.

More specifically, when bubbles have become intermixed in the ink inside the nozzle 51 and the pressure chamber 52, ink can no longer be discharged from the nozzles even if the actuator 58 is operated. Also, when the ink viscosity inside the nozzle 51 has increased over a certain level, ink can no longer be discharged from the nozzle 51 even if the actuator 58 is operated. In these cases, a suctioning device to remove the ink inside the pressure chamber 52 by suction with a suction pump, or the like, is placed on the nozzle face of the print head 50, and the ink in which bubbles have become intermixed or the ink whose viscosity has increased is removed by suction.

However, this suction action is performed with respect to all the ink in the pressure chamber 52, so that the amount of ink consumption is considerable. Therefore, a preferred aspect is one in which a preliminary discharge is performed when the increase in the viscosity of the ink is small.

The cap 64 described with reference to FIG. 6 serves as the suctioning device and also as the ink receptacle for the preliminary discharge.

Compositional Example of Preliminary Curing Unit

Figure 7:
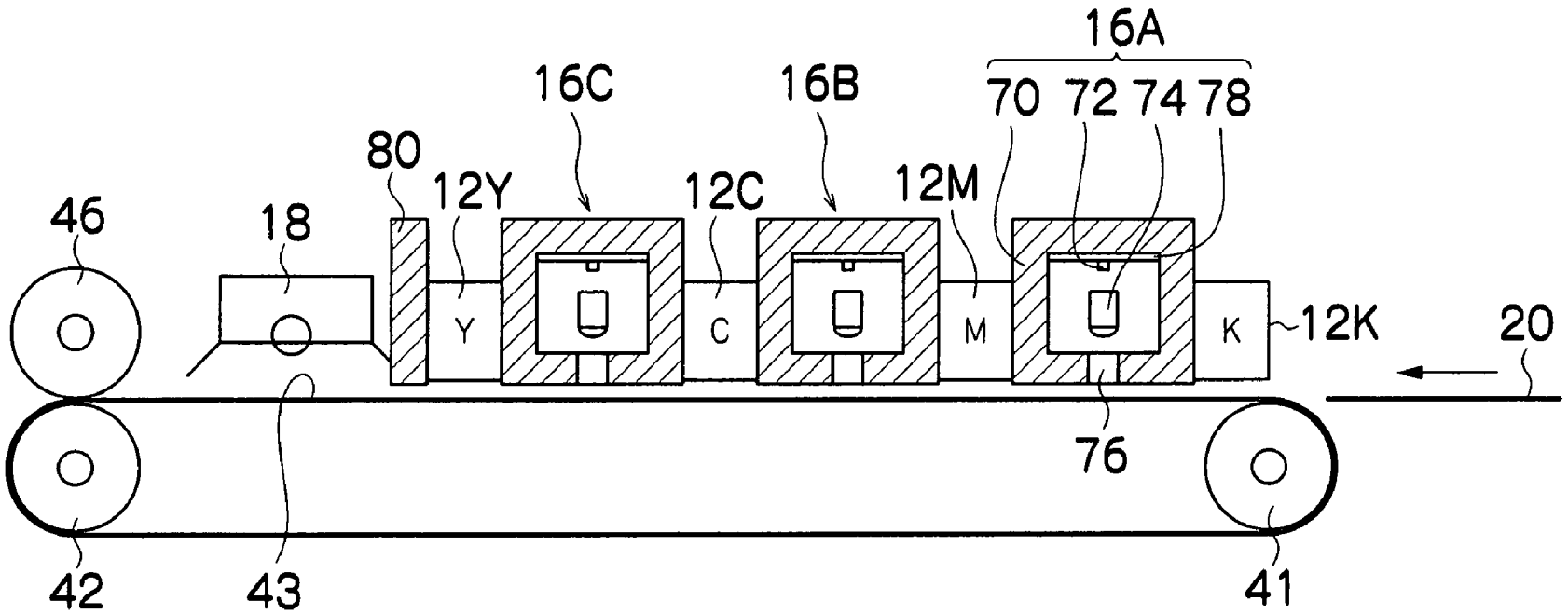
FIG. 7 is a schematic diagram showing an example of the structure of a preliminary curing section.

Here, an example of the composition of the preliminary curing light sources 16 is described. FIG. 7 is a schematic diagram showing an example of the structure of a preliminary curing section. In FIG. 7, parts which are common to FIG. 1 are labeled with the same reference numerals. As shown in FIG. 7, the preliminary curing light sources 16A, 16B and 16C each have a structure in which linear ultraviolet LED elements 72 and a lens systems 74 are disposed inside a light shroud 70. Ultraviolet light condensed into a linear shape is irradiated onto the recording paper 20 situated on the belt 43, via a slit-shaped opening section 76 formed in the base of the light shroud 70. Reference numeral 78 denotes a substrate on which the ultraviolet LED elements are supported.

A mercury lamp, metal halide lamp, or the like, is suitable for use as the main curing light source 18 disposed after the yellow head 12Y. The main curing light source 18 has a broader wavelength range then the ultraviolet LED elements 72, and it outputs a greater amount of light. Furthermore, a light shielding partition member 80 for preventing the light irradiated by the main curing light source 18 from entering into the yellow head 12Y is provided between the yellow head 12Y and the main curing light source 18.

The curing process caused by the preliminary curing light sources 16A, 16B, 16C (hereinafter, these light sources are indicated collectively by the reference numeral 16 in order to simplify the description) may create a semiliquid state (a state of increased viscosity) where the ink still contains an unhardened portion, in such a manner that color mixing due to interference between ink droplets of different colors on the surface of the recording medium is prevented. Therefore, desirably, respectively different light sources are used for the preliminary curing light sources 16 and for the main curing light source 18, and the relationship between the preliminary curing light source 16 and the main curing light source 18 satisfies at least one of the following conditions.

"Condition 1": Wavelength range of preliminary curing light source 16<wavelength range of main curing light source 18

"Condition 2" : Light intensity irradiated by preliminary curing light source 16<light intensity irradiated by main curing light source 18

"Condition 3": Irradiation range of curing light source 16<irradiation range of main curing light source 18

Here, the central wavelength and the wavelength range of the preliminary curing light source 16 and the main curing light source 18 are selected in accordance with the design specifications of the ink used.

Figure 8:
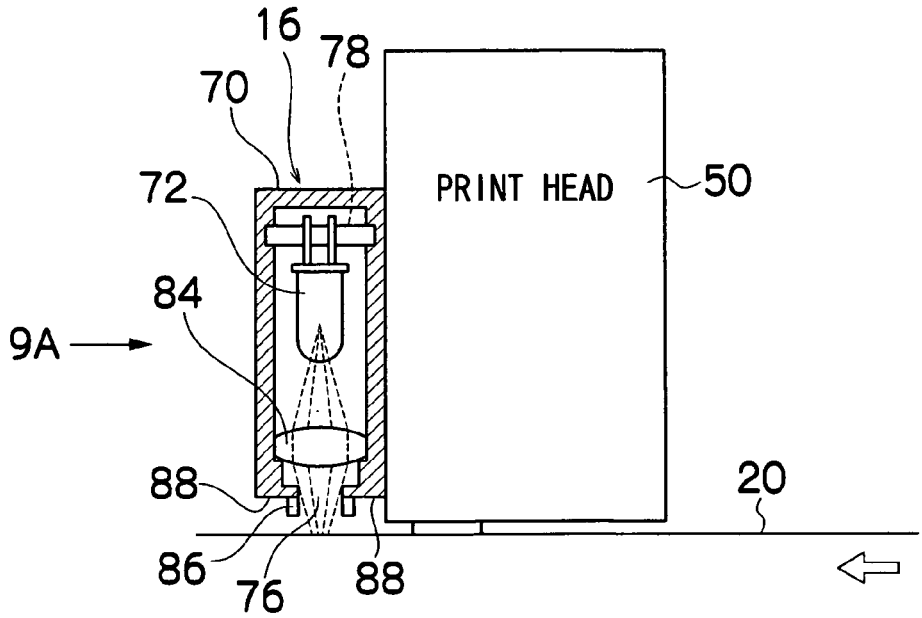
FIG. 8 is a partial cross-sectional diagram showing an example of the detailed structure of a preliminary curing light source.
Figure 9:
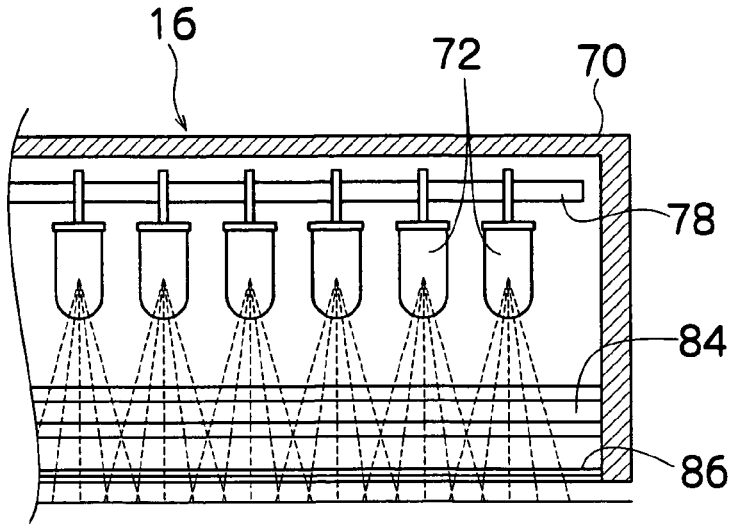
FIG. 9 is a cross-sectional diagram along arrow 9A in FIG. 8.

FIG. 8 is a partial cross-sectional diagram showing an example of the detailed composition of a preliminary curing light source 16, and FIG. 9 is a cross-sectional diagram along arrow 9A in FIG. 8. As shown in these diagrams, a plurality of ultraviolet LED elements 72 are arranged in the form of a line in the lengthwise direction of the head 50, on a substrate 78 that is disposed inside the light shroud 70. A cylindrical condensing lens 84 is provided below the row of ultraviolet LED elements 72.

A slit-shaped opening 76 forming a light output opening is formed in the base portion of the light shroud 70, and a light-shielding rim 86, which protrudes in the light output direction, is provided about the perimeter of the opening section 76. Furthermore, an ultraviolet absorbing coating 88 is provided on the lower surface of the light shroud 70 facing the recording paper 20.

Scattered light generated by the group of ultraviolet LED elements 72 is condensed into a linear shape in a direction substantially orthogonal to the paper conveyance direction, by the action of the cylindrical lens 84, and the light is irradiated onto the recording paper 20. Instead of the cylindrical lens 84, it is also possible to use a lens group having one or more aspherical surface shaped to achieve diffraction of the light, having a condensing power similar to that of the cylindrical lens 84.

Figure 10:
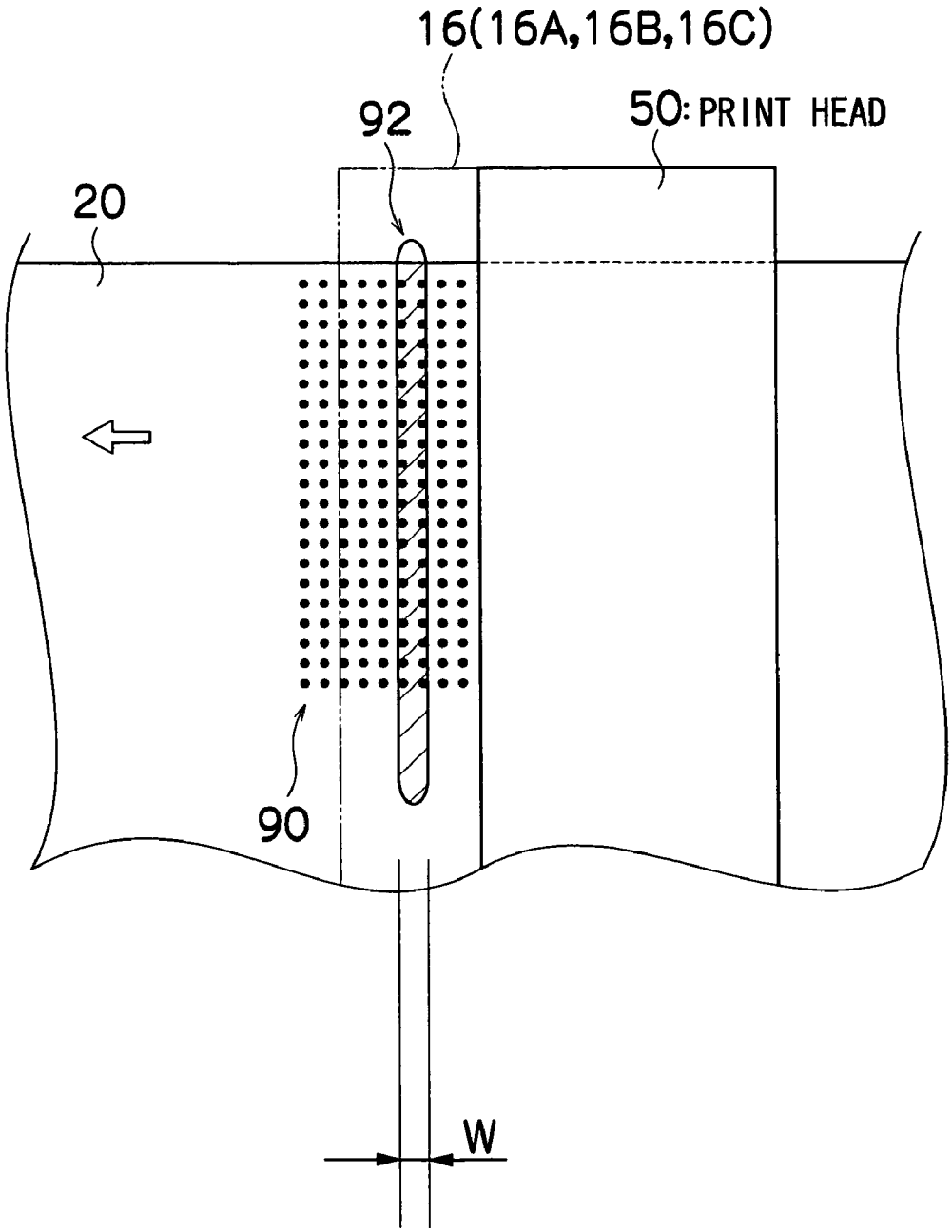
FIG. 10 is a plan diagram showing an example of an ultraviolet light irradiation area irradiated on a recording medium by a preliminary curing light source.

FIG. 10 shows an example of the irradiation area of the ultraviolet light irradiated onto the recording paper 20 by the preliminary curing light source 16 having the structure illustrated in FIGS. 8 and 9.

In FIG. 10, the recording paper 20 is conveyed from right to left in the direction of the outlined arrow and ink is discharged from the head 50. In this way, ink is deposited successively onto the recording paper 20 and dot lines 90 are formed successively in the main scanning direction. The irradiation area 92 of the ultraviolet light irradiated by the preliminary curing light source 16 on the downstream side of the head 50 comprises a linear area that is substantially parallel to the dot lines 90 in the main scanning direction, and this area has a narrow width W in the sub-scanning direction (where W is desirably several dot lines or less).

By selectively lighting up the group of ultraviolet LED elements 72 illustrated in FIGS. 8 and 9, and controlling the intensity of light emitted by each element, it is possible to achieve a desired irradiation range and light quantity (intensity) distribution in the irradiation area 92 of the ultraviolet light.

Figure 11:
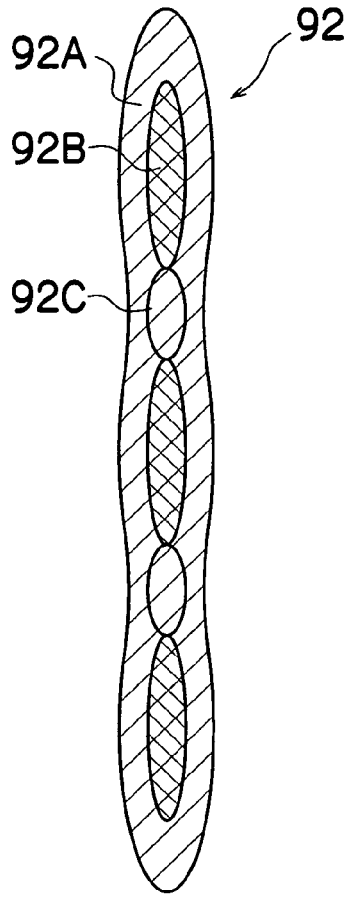
FIG. 11 is an enlarged diagram showing an example of the distribution of the light quantity distribution in the irradiation area of the ultraviolet light emitted from a preliminary curing light source 16.

FIG. 11 is an enlarged diagram showing an example of the light intensity distribution in the irradiation area of the ultraviolet light emitted from the preliminary curing light source 16. In this diagram, reference numeral 92A denotes an area of weak light, reference numeral 92B denotes an area of intense light, and reference numeral 92C denotes a colorless area (namely, an area where no droplet has been deposited by the immediately preceding head). In the colorless area 92C, since no ink droplets have been deposited onto the recording paper 20, there is no need to irradiate ultraviolet light onto this area in order to perform preliminary curing.

Desirably, the light emission positions and the emitted light intensities of the ultraviolet LED elements 72 are controlled suitably in accordance with the size of the recording paper 20 and the droplet ejection range of the head 50, in such a manner that the minimum necessary amount of light is generated, thereby minimizing adverse effects on the head 50.

Figure 12A:
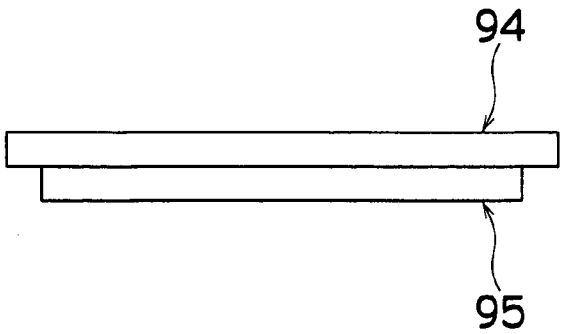
Figure 12B:
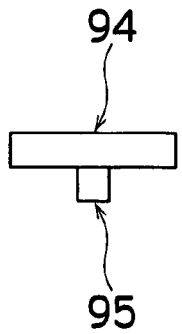
Figure 13A:
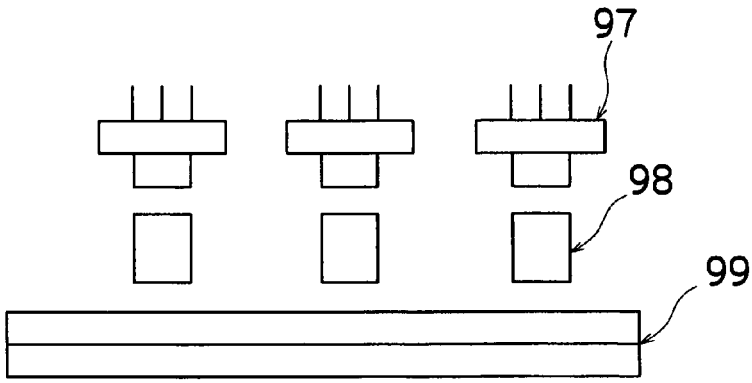
Figure 13B:
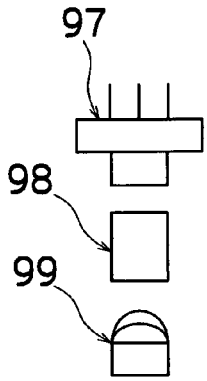

The composition of the preliminary curing light sources 16 is not limited to one using lamp-type ultraviolet LED elements 72 such as those in FIGS. 8 and 9, and it is also possible to arrange an LED element 95 one-dimensionally on a substrate 94, as shown in FIGS. 12A and 12B. Furthermore, a composition using laser diode (LD) elements instead of LED elements may also be adopted. For example, in place of the light source unit comprising a row of lamp-type ultraviolet LED elements 72 such as that illustrated in FIGS. 8 and 9, it is also possible to substitute a light source unit comprising LD elements 97, a condensing lens 98 and a cylindrical lens 99, as shown in FIGS. 13A and 13B.

Description of Control System

Figure 14:
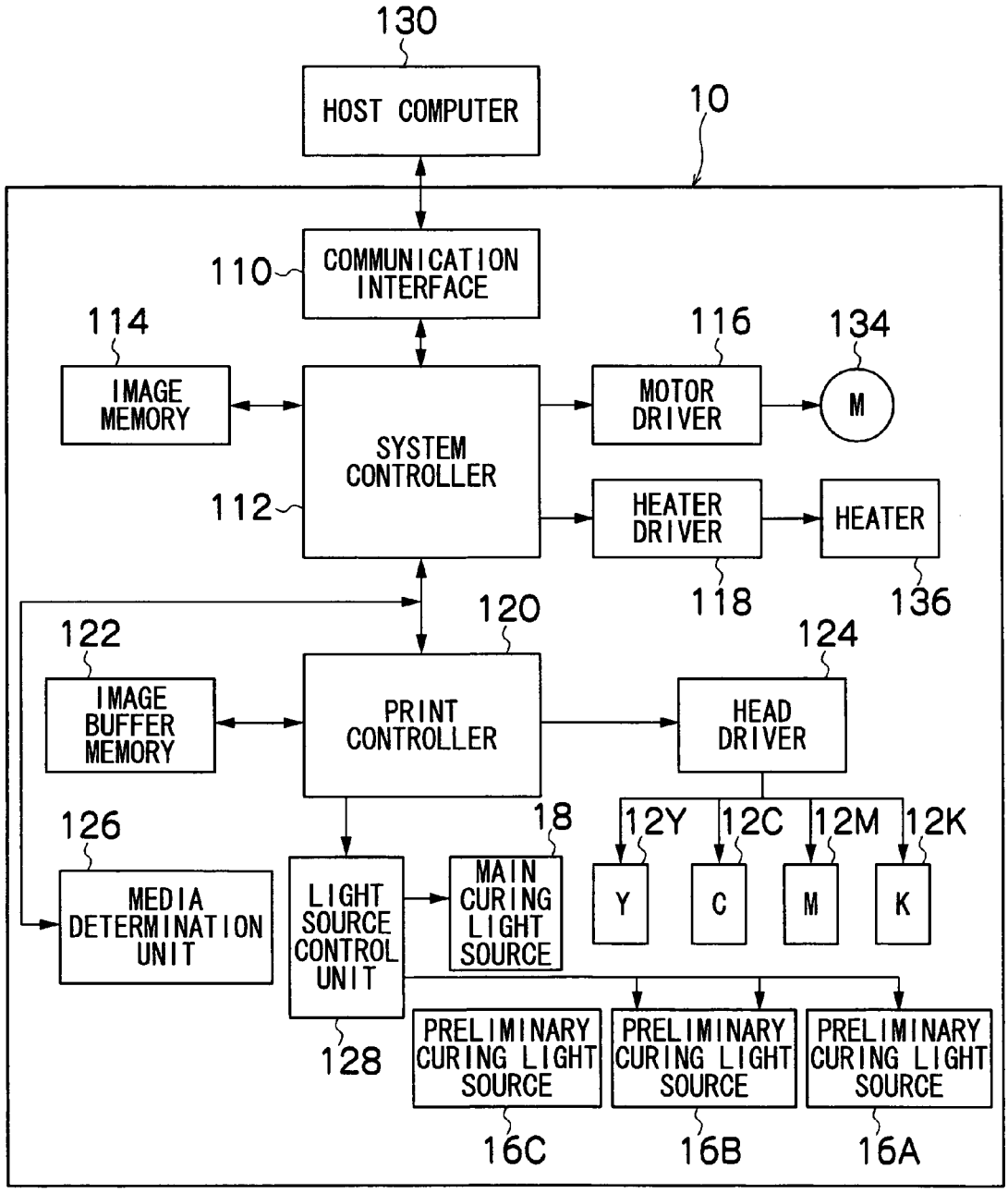
FIG. 14 is a principal block diagram showing the system composition of an image forming apparatus according to the present example.

Next, the control system of the image forming apparatus 10 is described. FIG. 14 is a block diagram of the principal components showing the system configuration of the image forming apparatus 10. The image forming apparatus 10 has a communication interface 110, a system controller 112, an image memory 114, a motor driver 116, a heater driver 118, a print controller 120, an image buffer memory 122, a head driver 124, a media determination unit 126, a light source control unit 128, and other components.

The communication interface 110 is an interface unit for receiving image data sent from a host computer 126. A serial interface such as USB, IEEE1394, Ethernet, wireless network, or a parallel interface such as a Centronics interface may be used as the communication interface 110. A buffer memory (not shown) may be mounted in this portion in order to increase the communication speed. The image data sent from the host computer 130 is received by the image forming apparatus 10 through the communication interface 110, and is temporarily stored in the image memory 114. The image memory 114 is a storage device for temporarily storing images inputted through the communication interface 110, and data is written and read to and from the image memory 114 through the system controller 112. The image memory 114 is not limited to memory composed of a semiconductor element, and a hard disk drive or another magnetic medium may be used.

The system controller 112 controls the communication interface 110, image memory 114, motor driver 116, heater driver 118, and other components. The system controller 112 has a central processing unit (CPU), peripheral circuits therefor, and the like. The system controller 112 controls communication between itself and the host computer 130, controls reading and writing from and to the image memory 114, and performs other functions, and also generates control signals for controlling a heater 136 and the motor 134 in the conveyance system.

The motor driver (drive circuit) 116 drives the motor 134 in accordance with commands from the system controller 112. The heater driver (drive circuit) 118 drives the heating drum 34 and the heaters 136 or the like in accordance with commands from the system controller 112.

The print controller 120 is a control unit having a signal processing function for performing various treatment processes, corrections, and the like, in accordance with the control implemented by the system controller 112, in order to generate a signal for controlling printing, from the image data in the image memory 114, and it supplies the print control signal (print data) thus generated to the head driver 124. Prescribed signal processing is carried out in the print controller 120, and the discharge amount and the discharge timing of the ink droplets from the heads of the respective colors 12K, 12M, 12C and 12Y are controlled via the head drier 124, on the basis of the image data. By this means, prescribed dot size, dot positions, or coating of protective liquid can be achieved.

The print controller 120 is provided with the image buffer memory 122; and image data, parameters, and other data are temporarily stored in the image buffer memory 122 when image data is processed in the print controller 120. The aspect shown in FIG. 14 is one in which the image buffer memory 122 accompanies the print controller 120; however, the image memory 114 may also serve as the image buffer memory 122. Also possible is an aspect in which the print controller 120 and the system controller 112 are integrated to form a single processor.

The head driver 124 drives the actuators 58 for the print heads 12K, 12C, 12M and 12Y of the respective colors on the basis of the print data received from the print controller 120. A feedback control system for keeping the drive conditions for the print heads constant may be included in the head driver 124.

The image data to be printed is externally inputted through the communications interface 110, and is stored in the image memory 114. At this stage, RGB image data is stored in the image memory 114, for example. The image data stored in the image memory 114 is sent to the print controller 120 through the system controller 112, and is converted to the dot data for each ink color by a known dithering algorithm, random dithering algorithm or another technique in the print controller 120.

The print heads 12K, 12M, 12C, 12Y are driven on the basis of the dot data thus generated by the print controller 120, so that ink is discharged from the heads. By controlling ink discharge from the print heads 12K, 12M, 12C, 12Y in synchronization with the conveyance speed of the recording medium 20, an image is formed on the recording medium 20.

The media determination unit 126 is a device for determining the type and size of the recording paper 20. This section uses, for example, a device for reading in information such as bar codes attached to the magazine 32 in the paper supply unit 22, or sensors disposed at a suitable position in the paper conveyance path (a paper width determination sensor, a sensor for determining the thickness of the paper, a sensor for determining the reflectivity of the paper, and so on). A suitable combination of these elements may also be used. Furthermore, it is also possible to adopt a composition in which information relating to the paper type, size, or the like, is specified by means of an input via a prescribed user interface, instead of or in conjunction with such automatic determining devices.

Information obtained by the media determination unit 126 is reported to the system controller 112 and/or the print controller 120, and is used to control ink ejection and to control the preliminary curing light sources 16A, 16B and 16C.

The light source control unit 128 is constituted by a preliminary curing light source control circuit for controlling the on and off switching, lighting up positions, light emission intensities, and the like, of the preliminary curing light sources 16A, 16B, 16C, and a main curing light source control circuit for controlling the on and off switching, the light emission intensity, and the like, of the main curing light source 18. The light source control unit 128 controls the light emission by the respective light sources (16A, 16B, 16C, 18) in accordance with the commands from the print controller 120.

Example of Control of Preliminary Curing Light Sources

Next, an example of light emission control for the preliminary curing light sources of the image forming apparatus 10 having the foregoing composition will be described.

Figure 15:
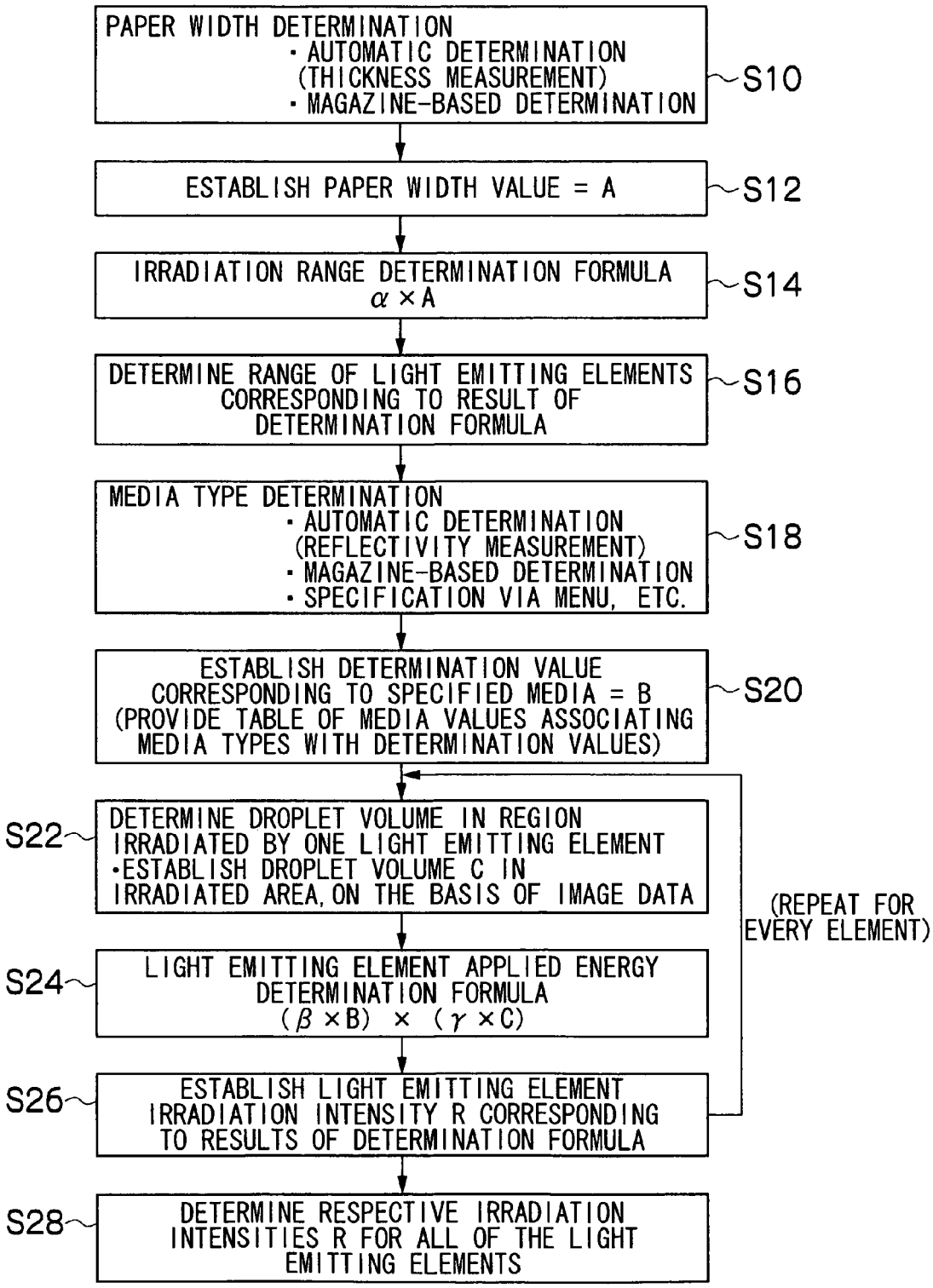
FIG. 15 is a flowchart showing an example of a control algorithm for a preliminary curing light source.

FIG. 15 is a flowchart showing an example of a control algorithm for a preliminary curing light source. As shown in this diagram, firstly, a paper width determination process is implemented (step S10). The paper width is determined by automatic determination based on evaluation of the thickness of the recording paper 20, or by determining the paper magazine, or the like. On the basis of the paper width determination result in step S10, the width value of the recording paper 20 is established to be A (step S12).

Next, the irradiation width (irradiation range) of the ultraviolet light irradiated by the preliminary curing light sources 16 is determined on the basis of the paper width A (step S14). The irradiation width is determined by the determination formula $\alpha \times A$, where $\alpha$ is a prescribed coefficient greater than zero.

On the basis of the result of the determination formula in step S14, a range for the light-emitting elements (LED element range) corresponding to the determination result is determined (step S16). In this way, only a group of LED elements having substantially the same width as the recording paper 20 are caused to light up. Subsequently, a process for determining the type of the recording paper 20 (media type determination) is performed (step S18). This determination may be based, for example, on automatic determination by measuring the optical reflectivity of the recording paper 20, or on determination of the paper magazine, or specification of a paper type via a user interface menu, or the like.

On the basis of the media type determination result in step S18, the determination value corresponding to the media type of the recording paper 20 used is established to be B (step S20). The determination value B may be established in accordance with the reflectivity of the recording medium. The image forming apparatus 10 comprises an information storage device (internal memory or external memory) which stores data for a media type table that associates media types with determination values. The determination value is determined by referring to the media type table.

Next, the droplet volume that is deposited in the range irradiated by one light emitting element is determined (step S22). In other words, in this process, the droplet volume C in the irradiation area of one LED element which generates light is established on the basis of the image data relating to the image to be printed.

Using the droplet volume C determined at step S22 and the determination value B determined at step S20, as well as prescribed coefficients $\beta$, $\gamma$ (where $\beta>0$ and $\gamma>0$), a formula for determining the energy applied by the light emitting element $(\beta \times B) \times (\gamma \times C)$ is calculated (step S24). An irradiation intensity R for the light emitting element is established in accordance with the results of the determination formula in step S24 (step S26).

By repeating steps S22 to S26 for all of the light emitting elements, an irradiation intensity R is determined for each one of the light emitting elements (step S28). In this way, the generation of light by the group of light emitting elements is controlled on the basis of the results obtained at step S28. The irradiation intensity of each light emitting element is controlled by controlling the on/off switching, the pulse width, the power, and the like. Stated more precisely, ultraviolet light for achieving preliminary curing is irradiated within a suitable required range of the point at which ink is deposited, and if the reflectivity of the recording medium is high, then the intensity of light emitted is reduced.

According to the image forming apparatus 10 having the foregoing composition, the preliminary curing light sources 16 have the specific function of preventing image degradation due to bleeding between colors, and rather than causing the ink to cure fully, they are only required to irradiate sufficient ultraviolet light to create a semi-hardened state. Therefore, light sources having a lower light output and narrower wavelength range than the irradiation energy required for full curing can be used as the preliminary curing light sources 16.

By composing the preliminary curing light sources 16 by means of a group of ultraviolet LED elements 72 or a group of LD elements 97 as in the present example, the number of elements that emit light and the intensity of light emitted by the elements can be controlled readily in accordance with the width of the recording medium, the range over which ink is deposited, the reflectivity of the recording paper, and the like. Even in a composition where preliminary curing light sources 16 are disposed in the vicinity of the head, it is still possible to avoid hardening of the ink near the nozzles, by controlling light emission so that the minimum necessary intensity of light is emitted.

In particular, by using a group of linearly arranged ultraviolet LED elements 72 as the preliminary curing light sources 16 and condensing the light efficiently onto the recording paper 20 by means of a cylindrical lens 84, or the like, it is possible to increase the energy density. Furthermore, since unnecessary irradiation of light onto surrounding areas is prevented by means of the light shroud 70, and since light is irradiated only onto a narrow range of the recording paper 20 by passing the light through a slit-shaped opening section 76, then the amount of light scattered and reflected onto the nozzles 51 is reduced. Moreover, by adopting a composition in which a light shielding rim 86 is provided on the lower surface of the light shroud 70, and an ultraviolet absorbing coating 88 is also formed, as illustrated in FIG. 8, it is possible to reduce the amount of light reflected onto the nozzles 51 yet further.

In this way, by adopting a composition which prevents adverse effects on the head 50, it becomes possible to position the preliminary curing light sources 16 in the vicinity of the head 50, and light for the purpose of preliminary curing can be irradiated onto a permeable medium (a recording medium in which the ink is fixed by permeating inside the medium) while the permeation has still not reached the inside of the medium.

Furthermore, even if preliminary curing sections are provided between the heads of respective colors, space savings can still be achieved and energy can also be saved in proportion to the increase in number of light sources.

Second Embodiment

General Composition of Inkjet Recording Apparatus

Figure 16:
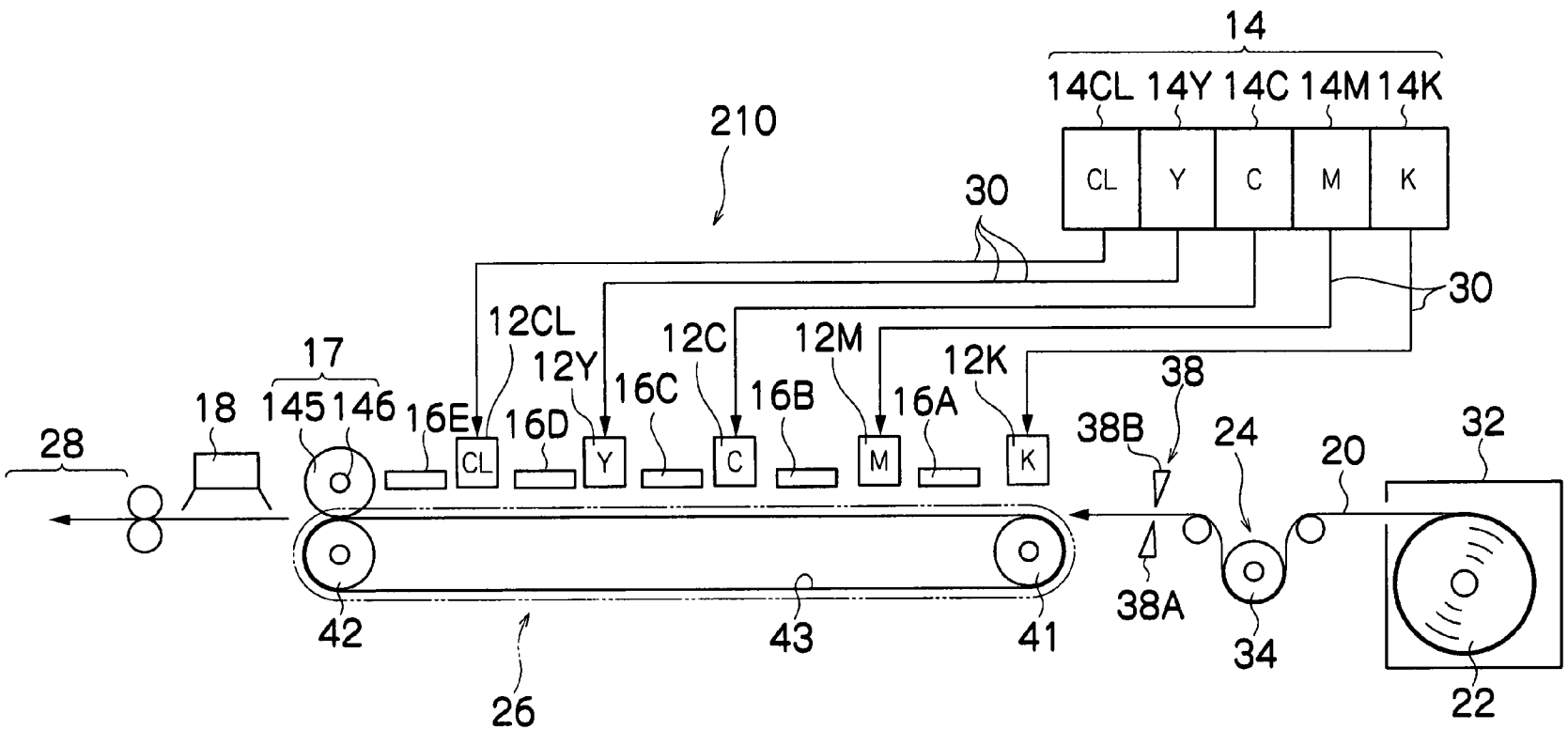
FIG. 16 is a general schematic drawing of an image forming apparatus relating to a second embodiment of the present invention.

FIG. 16 is a diagram of the general composition of an image forming apparatus according to a second embodiment of the present invention. Parts which are the same or similarly to those in the compositional example illustrated in FIG. 1 are labeled with the same reference numerals and further description thereof is omitted here.

As shown in FIG. 16, this inkjet recording apparatus 210 comprises: a plurality of inkjet heads (hereafter, called "heads") 12K, 12M, 12C, 12Y, 12CL provided corresponding to respective ink colors, namely, black (K), magenta (M), cyan (C), yellow (Y) and clear (CL); an ink storing and loading unit 14 for storing ultraviolet curable ink (so-called "UV ink") to be supplied to the heads 12K, 12M, 12C, 12Y and 12CL; semiliquid forming light sources 16A, 16B, 16C, 16D, 16E disposed respectively on the downstream side of each head; a pressurizing and fixing unit 17 disposed downstream of the semiliquid forming light source 16E following the last head (the clear-ink head 12CL); a main curing unit 18 disposed after the pressurizing and fixing unit 17; a paper supply unit 22 for supplying recording paper 20 forming a recording medium; a decurling unit 24 for removing curl in the recording paper 20; a suction belt conveyance unit 26, disposed facing the nozzle faces (ink discharge faces) of the heads 12K, 12M, 12C, 12Y and 12CL and the light emitting faces of the semiliquid forming light sources 16A to 16E, for conveying the recording paper 20 while keeping the recording paper 20 flat; and a paper output unit 28 for outputting recorded recording paper (printed matter) to the exterior.

Ultraviolet curable ink is an ink containing a component which hardens (polymerizes) upon application of ultraviolet energy (namely, an ultraviolet curable component, such as a monomer, oligomer, or a low-molecular-weight homopolymer, copolymer, or the like), and a polymerization initiator. The ink therefore has a property whereby, when the ink is irradiated with ultraviolet light, it starts to polymerize and as the polymerization progresses, the viscosity of the ink increases and finally it hardens.

The ink storing and loading unit 14 has ink tanks 14K, 14M, 14C, 14Y and 14CL for storing the inks of the colors corresponding to the print heads 12K, 12M, 12C, 12Y and 12CL, and the tanks are connected to the print heads 12K, 12M, 12C, 12Y and 12CL through prescribed channels 30. The ink storing and loading unit 14 has a warning device (for example, a display device or an alarm sound generator) for warning when the remaining amount of any ink is low, and has a mechanism for preventing loading errors among the colors. Here, the clear head 12CL does not apply color points during formation of a color image, but rather it applies clear ink taking account of the amount of ink deposited by the other colored inks (K, M, C, Y), in such a manner that the amount of ink deposited at each printing point is approximately uniform.

After decurling in the decurling unit 24, the cut recording paper 20 is delivered to the suction belt conveyance unit 26. The suction belt conveyance unit 26 has a configuration in which an endless belt 43 is set around rollers 41 and 42 in such a manner that at least the portion of the endless belt 43 facing the nozzle faces of the print heads 12K, 12M, 12C, 12Y and 12CL forms a horizontal plane (flat plane).

The print heads 12K, 12M, 12C, 12Y and 12CL are full line heads having a length corresponding to the maximum width of the recording paper 20 used with the image forming apparatus 210, and comprising a plurality of nozzles for discharging ink arranged on a nozzle face through a length exceeding at least one edge of the maximum-size recording paper 20 (namely, the full width of the printable range).

The print heads 12K, 12M, 12C, 12Y and 12CL are arranged in color order (black (K), magenta (M), cyan (C), yellow (Y) and clear (CL)) from the upstream side in the delivery direction of the recording paper 20, and these respective heads 12K, 12M, 12C, 12Y and 12CL are fixed extending in a direction substantially perpendicular to the conveyance direction of the recording paper 20. In this head arrangement sequence, the heads are arranged in order of ascending curing sensitivity of the inks, from the upstream side towards the downstream side.

A color image can be formed on the recording paper 20 by discharging inks of different colors from the print heads 12K, 12M, 12C, 12Y and 12CL, respectively, onto the recording paper 20 while the recording paper 20 is conveyed by the suction belt conveyance unit 26. The clear ink serves to maintain the flatness of the ink surface and it is discharged onto regions where no colored ink has been deposited, or regions where only a small amount of colored ink has been deposited.

By adopting a configuration in which full line heads 12K, 12M, 12C, 12Y and 12CL having nozzle rows covering the full paper width are provided for each separate color in this way, it is possible to record an image on the full surface of the recording paper 20 by performing just one operation of moving the recording paper 20 relatively with respect to the heads 12K, 12M, 12C and 12Y in the paper conveyance direction (the sub-scanning direction), (in other words, by means of one sub-scanning action). A single pass image forming apparatus 210 of this kind is able to print at high speed in comparison with a shuttle scanning system in which an image is printed by moving a recording head back and forth reciprocally in the main scanning direction, and hence print productivity can be improved.

Although a configuration with the four standard colors KMCY and clear (CL) inks is described in the present embodiment, the combinations of the ink colors and the number of colors are not limited to these. Light and/or dark inks can be added as required. For example, a configuration is possible in which inkjet heads for ejecting light-colored inks such as light cyan and light magenta are added.

The semiliquid forming light sources 16A to 16E disposed on the downstream side of each head have a length corresponding to the maximum width of the recording paper 20, similarly to the heads, and they are fixed extending in a direction substantially perpendicular to the conveyance direction of the recording paper 20. LED elements, or LD elements having a narrow light emission wavelength range compared to the main curing light source 18 are suitable for use in the semiliquid forming light sources 16A to 16E. Here, the central wavelength and the light emission wavelength range of the semiliquid forming light sources 16A to 16E and the main curing light source 18 are selected in accordance with the design specifications of the ink used.

The respective semiliquid forming light sources 16A to 16E irradiate ultraviolet light having an energy sufficient to cause the ink deposited by the head 12K, 12M, 12C, 12Y or 12CL positioned adjacently on the upstream side thereof, to change to a semiliquid state (namely, having a viscosity which prevents the occurrence of color mixing even in the case of contact with ink of another color).

More specifically, the semiliquid forming light sources 16A to 16E have the function of changing ink that has been deposited onto the recording paper 20 by a preceding head 12K, 12M, 12C, 12Y or 12CL, to a pliable (deformable) ink state that is not equivalent to full curing, and they also have the function of semi-curing the ink on the recording paper 20 to a degree which prevents the ink from mixing with ink of a different color discharged from a subsequent head 12M, 12C, 12Y or 12CL, and thus preventing the occurrence of color bleeding.

When the recording paper 20 has passed under an upstream head and before it passes below the next head, light is irradiated from a semiliquid forming light source 16A to 16E, thereby changing the ink on the recording paper 20 to a semi-cured state, in such a manner that droplets of a different color can be deposited by the subsequent print head.

In the example shown in FIG. 16, after droplets have been ejected by the black head 12K, they are passed through the light irradiated by the semiliquid forming light source 16A, and the droplets of black ink are thereby changed to a semiliquid state, whereupon droplets are ejected by the magenta head 12M. Similarly, after ejection of droplets by the magenta head 12M, the droplets pass through light irradiated by the semiliquid forming light source 16B, whereupon droplets are ejected by the cyan head 12C, passed through the light irradiated by the semiliquid forming light source 16C, and then droplets are ejected by the yellow head 12Y When droplets have been ejected by the yellow head 12Y, they are passed through the light irradiated by the semiliquid forming light source 16D, whereupon droplets are ejected by the clear head 12CL and are passed through light irradiated by the semiliquid forming light source 16E.

Ink discharged from a head positioned towards the upstream side in the conveyance direction of the recording paper 20 is passed more times through the semiliquid forming regions, but as described above, since the heads are arranged in order of ascending curing sensitivity of their respective colors, then when the ink has passed by the last semiliquid forming light source 16E, there will be little difference in the progress of curing of the inks of different colors on the recording paper 20 and all the inks will be in a uniform semiliquid state.

The pressurizing and fixing unit 17 (flattening device) provided after the final semiliquid forming light source 16E is constituted by a roller 145 whose surface is coated with a resin having high separation characteristics. The roller 145 has a hollow structure and a heater 146, such as a halogen lamp, is provided in the central portion thereof, in such a manner that the image surface of the recording paper 20 is heated while being pressed by the roller 145. By heating and pressing the ink surface by means of the pressurizing and fixing unit 17, the undulations in the ink surface are flattened. Furthermore, if it is possible to flatten the ink surface by pressure alone, without applying heat, then the heating action can be omitted. In cases in which printing is performed with dye-based ink on porous paper, blocking the pores of the paper by the application of pressure prevents the ink from coming contact with ozone and other substance that cause dye molecules to break down, and has the effect of increasing the durability of the print.

The pressurizing and fixing unit 17 has a mechanism which allows the applied pressure to be adjusted (for example, it has a variable structure in which the roller 145 applies a pressing force by means of spring loading), and it is controlled to a suitable pressure in accordance with the thickness of the recording paper 20 and the amount of ink.

A main curing light source 18 is provided downstream of the pressurizing and fixing unit 17. The main curing light source 18 uses a metal halide lamp or a mercury lamp, or the like, having a broader light emission wavelength range and a greater irradiation light output than the semiliquid forming light sources 16A to 16E.

The recording paper 20 that has undergone a flattening process by the pressurizing and fixing unit 17 is irradiated with light sufficient to cure the ink completely, by the main curing light source 18, and hence main curing is performed.

Furthermore, the roller 145 of the pressurizing and fixing unit 17 is constituted in such a manner that it can be moved to a prescribed withdrawal position where it does not make contact with the recording paper 20, by means of a movement mechanism (not illustrated). When carrying out a flattening process of the ink surface, pressure is applied by positioning the roller 145 at a prescribed position (flattening process position) where it makes contact with the recording paper 20. On the other hand, if the ink surface does not require a flattening process, then the roller 145 is withdrawn to the withdrawal position, and the ink is cured and fixed by the main curing light source 18, without applying pressure. By this means, it is also possible to form images in which the ink surface remains with undulations.

The device for switching the pressurizing and fixing unit 17 between a pressurizing and non-pressurizing state may be a structure which allows the pressurizing and fixing unit 17 to be removed (separated), rather than the withdrawal mechanism described above. In other words, a mode can be adopted in which, if a flattening process is not required, then the pressurizing and fixing unit 17 (or a portion of same) is removed from the image forming apparatus 210 and the flattening process is omitted.

In this way, a printed object is generated by passing through the main curing process of the main curing light source 18 (a process which cures and fixes the ink to such a degree than image degradation will not occur as a result of ink smearing, or the like, in conveyance and handling) and this printed object is output from the paper output unit 28. Although not shown in FIG. 16, the paper output unit 28 is provided with a sorter for collecting images according to print orders.

Structure of Head

The heads 12K, 12C, 12M, 12Y and 12CL of the respective colors shown in FIG. 16 have a common structure, which is similar to the structure of the head 50 illustrated in FIGS. 2A through 5. Therefore, further description thereof is omitted here.

Composition of Ink Supply System

Furthermore, the composition of the ink supply system in the image forming apparatus 210 illustrated in FIG. 16 is similar to the composition illustrated in FIG. 6 and description thereof is omitted here.

Example of Structure of Semiliquid Forming Curing Section

Next, an example of the structure of a semiliquid forming curing section is described. The structure of the semiliquid forming light sources 16A to 16E is similar to that of the preliminary curing light sources 16 described with reference to FIGS. 8 and 9. In other words, taking the reference numeral 16 to represent the semiliquid forming light sources 16A to 16E in FIG. 16, and referring to FIGS. 8 and 9, the semiliquid forming light source 16 has a structure in which a plurality of ultraviolet LED elements 72 are arranged in a linear fashion following the lengthwise direction of the head 50, inside a light shroud 70, and a condensing cylindrical lens 84 is disposed below this row of ultraviolet LED elements 72. Reference numeral 78 denotes a substrate on which the ultraviolet LED elements are supported.

A slit-shaped opening 76 forming a light output opening is formed in the base portion of the light shroud 70, and a light-shielding rim 86 which protrudes in the light output direction is provided about the perimeter of the opening section 76. Furthermore, an ultraviolet absorbing coating 88 is provided on the base surface of the light shroud 70 facing the recording paper 20.

Scattered light generated by the group of ultraviolet LED elements 72 is condensed into a linear shape in a direction substantially orthogonal to the paper conveyance direction, by the action of the cylindrical lens 84, and the light is irradiated onto the recording paper 20. Instead of the cylindrical lens 84, it is also possible to use a lens group having one or more aspherical surface shaped to achieve diffraction of the light, having a condensing power similar to that of the cylindrical lens 84.

By selectively lighting up the group of ultraviolet LED elements 72 illustrated in FIGS. 7 and 8, and controlling the intensity of light emitted by each element, it is possible to achieve a desired irradiation range and light quantity (intensity) distribution in the irradiation area of the ultraviolet light.

The light emission positions and the emitted light intensities of the ultraviolet LED elements 72 are controlled suitably in accordance with the size of the recording paper 20 and the droplet ejection range of the head 50, in such a manner that the minimum necessary amount of light is generated, thereby minimizing adverse effects on the head 50.

The composition of the semiliquid forming light sources 16 is not limited to one using lamp-type ultraviolet LED elements 72 such as those in FIGS. 7 and 8, and it is also possible to arrange an LED element one-dimensionally on a substrate. Furthermore, a composition using laser diode (LD) elements instead of LED elements may also be adopted.

Description of Control System

Next, the control system of the image forming apparatus 210 according to the second embodiment will be described.

Figure 17:
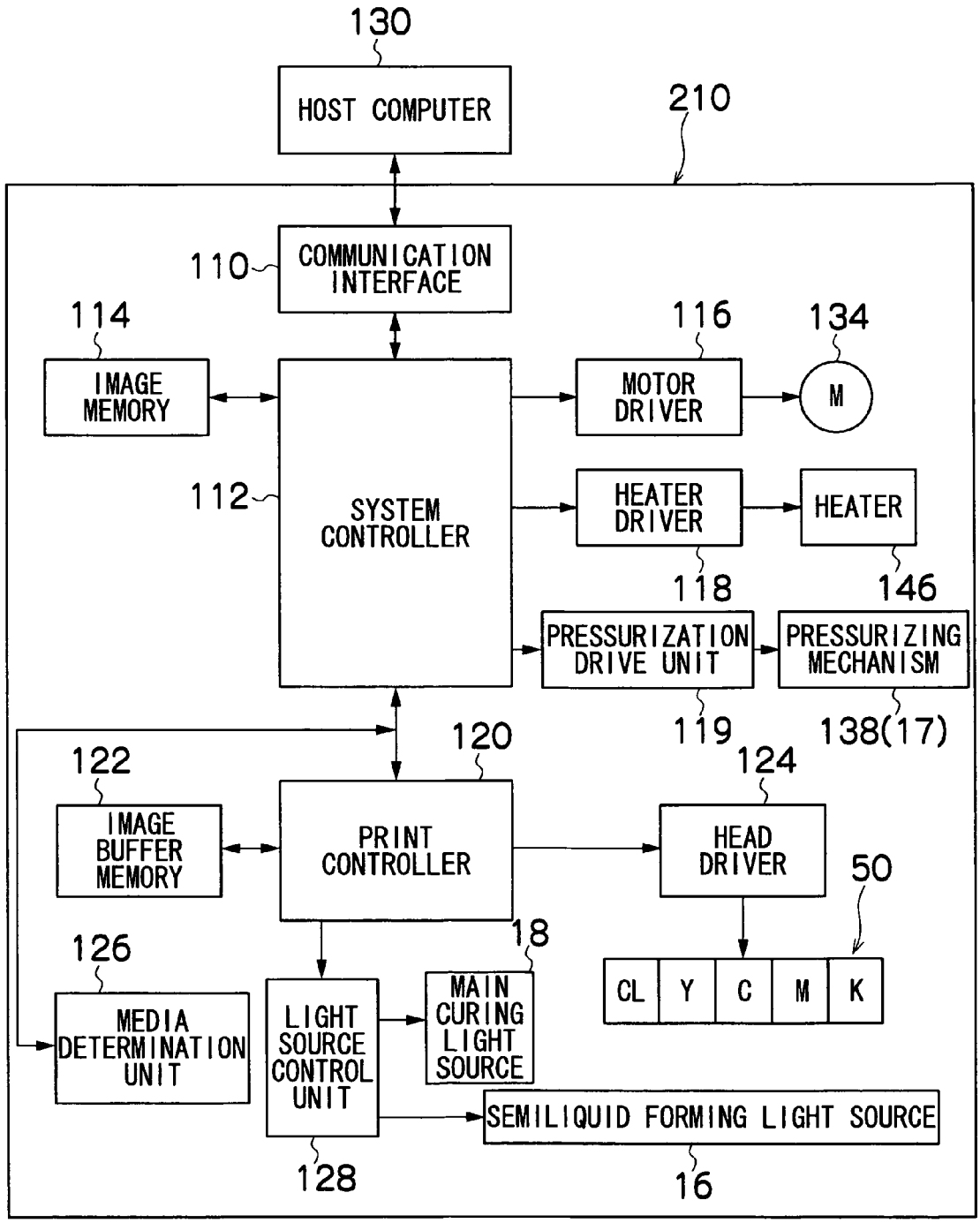
FIG. 17 is a principal block diagram showing the system composition of an image forming apparatus relating to a second embodiment.

FIG. 17 is a principal block diagram showing the system composition of the image forming apparatus 210. Parts which are the same or similar to those in the compositional example shown in FIG. 14 are labeled with the same reference numerals and further description thereof is omitted here.

The image forming apparatus 210 comprises a communications interface 110, a system controller 112, an image memory 114, a motor driver 116, a heater driver 118, a pressurization drive unit 119, a print controller 120, an image buffer memory 122, a head driver 124, a media determination unit 126, a light source control unit 128, and the like.

The system controller 112 is a control unit for controlling the various sections, such as the communications interface 110, the image memory 114, the motor driver 116, the heater driver 118, the pressurization drive unit 119, and the like. The system controller 112 is constituted by a central processing unit (CPU) and peripheral circuits thereof, and the like, and in addition to controlling communications with the host computer 130 and controlling reading and writing from and to the image memory 114, or the like, it also generates control signals for controlling the motor 134 of the conveyance system, the heater 146, the pressurizing mechanism 138 of the pressurizing and fixing unit 17, and the like.

The motor driver 116 is a driver (drive circuit) which drives the motor 134 in accordance with instructions from the system controller 112. The heater driver 118 is a driver which drives the heating drum 34 and the heater 146 inside the roller 145 of the pressurizing and fixing unit 17, as well as other heaters, in accordance with instructions from the system controller 112.

The pressurization drive unit 119 is a device which changes the applied pressure by driving the pressurizing mechanism 138 in accordance with instructions from the system controller 112, as well as moving the pressurizing mechanism 138 between a withdrawal position and a flattening process position.

The head driver 124 drives the actuators 58 which drive discharge in the respective heads 50, on the basis of the dot data supplied from the print controller 120. A feedback control system for maintaining constant drive conditions for the print heads may be included in the head driver 124.

The image data to be printed is externally inputted through the communications interface 110, and is stored in the image memory 114. At this stage, RGB image data is stored in the image memory 114, for example. The image data stored in the image memory 114 is sent to the print controller 120 through the system controller 112, and is converted to the dot data for each ink color by a known dithering algorithm, random dithering algorithm or another technique in the print controller 120.

The print heads 50 are driven on the basis of the dot data thus generated by the print controller 120, so that ink is discharged from the heads 50. By controlling ink discharge from the heads 50 in synchronization with the conveyance speed of the recording paper 20, an image is formed on the recording paper 20.

Information obtained by the media determination unit 126 is reported to the system controller 112 and/or the print controller 120, and is used to control ink discharge and to control the semiliquid forming light sources 16 and the pressurizing mechanism 138, and the like.

The light source control unit 128 is constituted by a semiliquid forming light source control circuit for controlling the on and off switching, lighting up positions, light emission intensities, and the like, of the semiliquid forming light sources 16; and a main curing light source control circuit for controlling the on and off switching, the light emission intensity, and the like, of the main curing light source 18. The light source control unit 128 controls the light emission by the respective light sources (16, 18) in accordance with commands from the print controller 120.

Example of Control of Image Forming Apparatus 210

Figure 18:
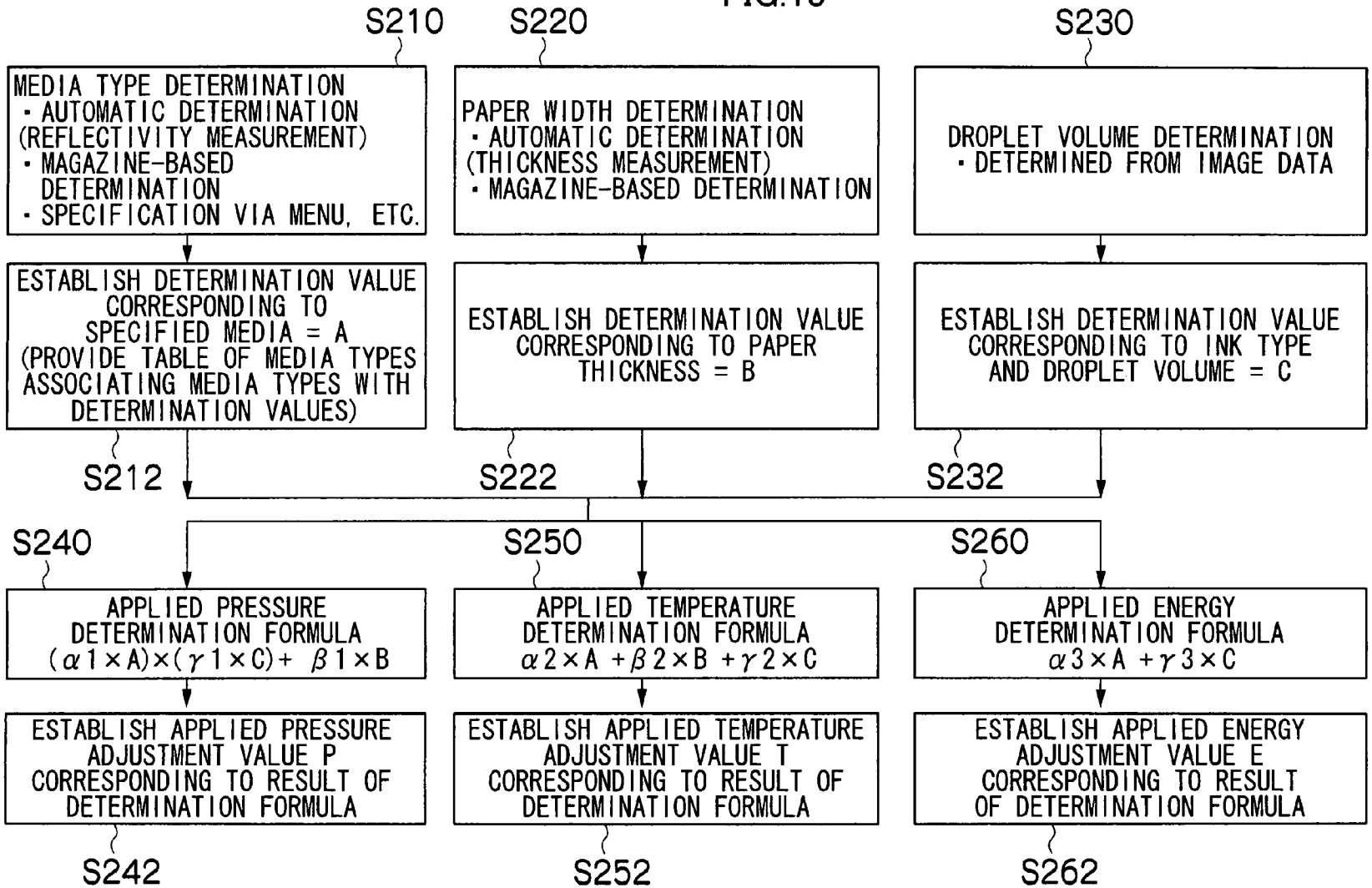
FIG. 18 is a flowchart showing an example of a control procedure in an image forming apparatus according to the second embodiment.

Next, an example of the control of the image forming apparatus 210 having the foregoing composition will be described. FIG. 18 is a flowchart showing an example of a control algorithm for the image forming apparatus 210. In this example, the semiliquid forming conditions and the pressurization and heating conditions are controlled on the basis of the type of paper (media), the amount of ink deposited, and the like.

As shown in FIG. 10, firstly, in a media type determination process (step S210), the type of recording medium used is determined. This determination may be based, for example, on automatic determination by measuring the optical reflectivity of the recording paper 20, or on determination of the paper magazine, or specification of a paper type via a user interface menu, or the like.

On the basis of the media type determination result in step S210, the determination value corresponding to the media type used is established to be A (step S212). The image forming apparatus 210 comprises an information storage device (internal memory or external memory) which stores data for a media type table that associates media types with determination values. The determination value is determined by referring to the media type table.

In parallel with, or subsequently to, the media type determination process described above (step S210), a process for determining the paper thickness is carried out (step S220). The paper width is determined by automatic determination based on evaluation of the thickness of the recording paper 20, or by determining the paper magazine, or the like. On the basis of the result of the paper thickness determination in step S220, a determination value corresponding to the paper thickness is established as B (step S222).

Furthermore, the ink droplet volume is determined on the basis of the data relating to the image to be printed (step S230), and a determination value corresponding to this ink droplet volume is established as C, taking account of the type of ink used, and other factors (step S232).

An applied pressure is determined by using the determination values A, B and C determined in this way. For example, when determining a suitable value for the applied pressure, a prescribed weighting is applied to the droplet volume and the paper thickness, and since the permeation conditions vary depending on the type of media, and the like, the media type expression is multiplied as a coefficient, and the suitable pressure is calculated using an applied pressure determination formula (1) as follows (step S240):

$$(\alpha 1 \times A) \times (\gamma 1 \times C) + \beta 1 \times B, \quad (1)$$

where the coefficients $\alpha 1$, $\gamma 1$, and $\beta 1$ are respective uniform values.

The result of this applied pressure determination formula (1) is derived, and an applied pressure adjustment value P is established corresponding to this result (step S242).

As stated previously, the applied pressure is controlled during pressurization and fixing by, for example, adopting a composition in which the pressure is applied by means of spring loading of a nip roller (145), or a composition in which the pressure can be adjusted by extension or contraction of a spring in accordance with the applied pressure adjustment value P determined at step S242. In this way, it is possible to prevent peeling and cracking of the ink by avoiding large variations in the pressurization conditions applied to the ink (namely, by controlling the variation in pressurization conditions to a prescribed range).

Moreover, the heating temperature is determined using the determination values A, B and C derived in steps S212, S222 and S232. For example, when setting a suitable heating temperature, weightings are given to the media type, the paper thickness and the droplet volume, and since these factors are generally independent of each other, the temperature is calculated using the heating temperature determination formula (2) indicated below (step S250):

$$\alpha 2 \times A + \beta 2 \times B + \gamma 2 \times C, \quad (2)$$

where the coefficients $\alpha 2$, $\gamma 2$, and $\beta 2$ are respective uniform values.

The result of this heating temperature determination formula (2) is derived, and a heating temperature adjustment value T is established corresponding to this result (step S252).

As stated previously, the heating temperature can be controlled during pressurizing and fixing by adopting a composition in which a heater 146, such as a halogen lamp, is provided in the central portion of the pressurizing and fixing roller 45, and the temperature of the heater 146 is adjustable in accordance with the heating temperature adjustment value T determined in step S252.

Moreover, the applied energy is determined using the determination values A, B and C derived in steps S212, S222 and S232. For example, in order to determine a suitable value for the applied energy, since the thickness of the paper has virtually no effect on this value, the media type and the droplet volume are given certain weightings, and since these factors are generally independent of each other, the applied energy is calculated using an applied energy determination formula (3) as follows (step S260):

$$\alpha 3 \times A + \gamma 3 \times C, \quad (3)$$

where the coefficients $\alpha 3$ and $\gamma 3$ are respective uniform values.

The result of the applied energy determination formula (3) is derived, and an applied energy adjustment value E is established corresponding to this result (step S262).

The irradiation intensity of the semiliquid forming light sources 16 can be adjusted in accordance with this applied energy adjustment value E.

In this way, by setting the pressurization and heating conditions of the pressurizing and fixing unit 17 and the irradiation energy conditions of the semiliquid forming light sources 16 to optimal conditions, on the basis of information indicating the characteristics of the media and the amount of ink deposited, it becomes possible to achieve a stable fixing process, and hence peeling or cracking of the ink can be prevented.

The foregoing description related to examples where ultraviolet curable ink is used, but in implementing the present invention, the ink is not limited to an ink that is cured by light, and other radiation curable inks which are cured by electron beams, X rays, or the like, may also be used. In this case, a preliminary curing unit and a main curing unit are provided, which use radiation sources suitable for activating the curing agent (namely, activating polymerization), according to the type of ink used.

Furthermore, in implementing the present invention, it is also possible to use a phase change ink, such as a solid ink, rather than an ink which hardens due to polymerization. A solid ink has properties such that it is solid at normal temperature and reduces in viscosity when it is heated. Therefore, the conveyance system is heated to a level whereby the ink deposited on the recording paper 20 does not harden completely, and the ink discharged onto the recording paper 20 is kept in the state of a highly viscous liquid and conveyed to the pressurizing and fixing unit 17. After undergoing a flattening process while in this flexible liquid state, it is passed to the main curing unit (main fixing unit). In this case, a fixing device including a cooling device is provided in the main curing unit. The cooling device may be used on an air cooling system which cools the ink on the recording medium forcibly by supplying a flow of cold air to the recording medium, or a water cooling system which cools the surface of the recording medium by circulating cooling water in the vicinity of the recording medium, for instance, through the conveyance system. Naturally, various other cooling methods may also be adopted.

Figure 19:
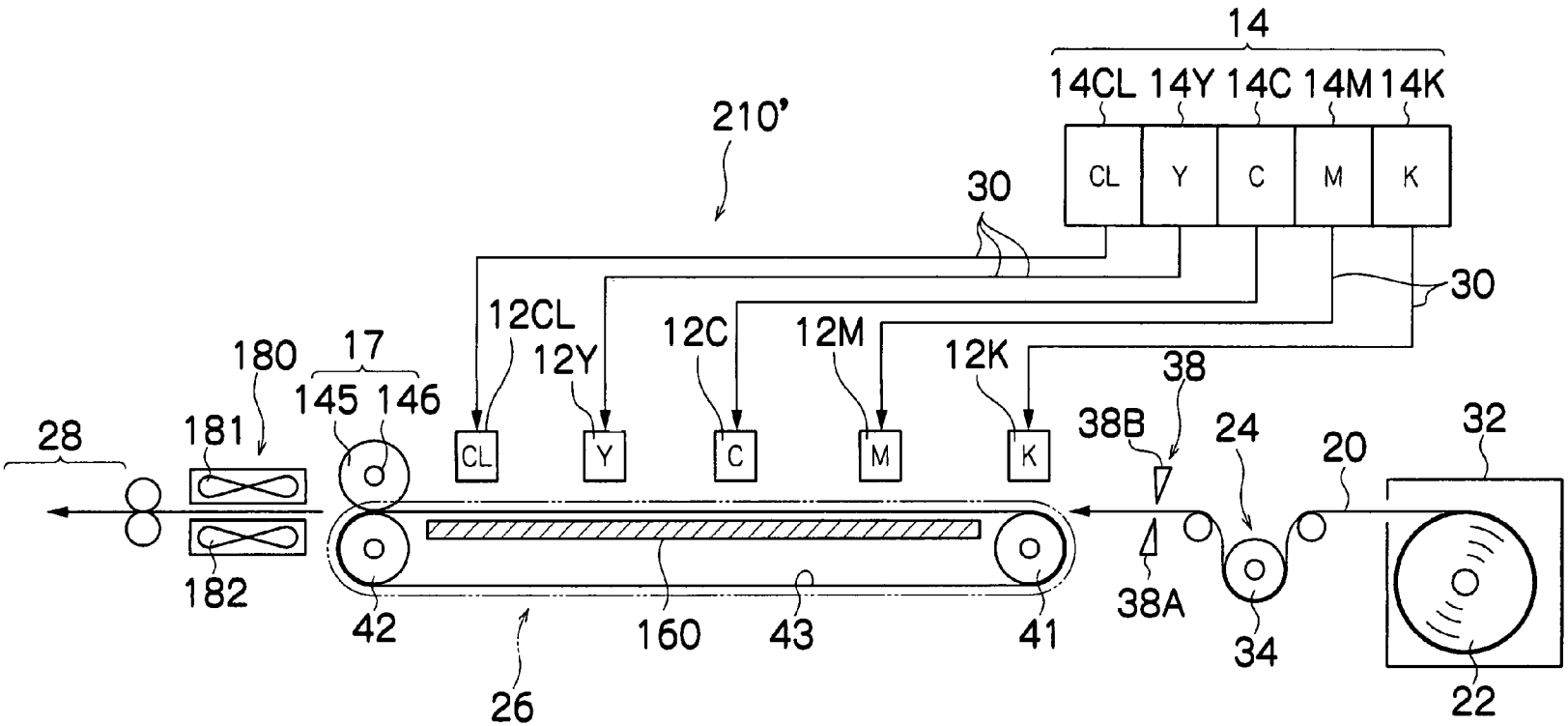
FIG. 19 is a diagram showing an example of the composition of an image forming apparatus in a case where phase change ink is used.

FIG. 19 shows a compositional example of an image forming apparatus in a case where phase change ink is used. In FIG. 19, members which are the same as or similar to those in FIG. 16 are labeled with the same reference numerals and description thereof is omitted here. The image forming apparatus 210' shown in FIG. 19 comprises a heating unit 160 which is disposed in the conveyance section facing the nozzle surfaces of the heads 12K, 12M, 12C, 12Y and 12CL, and a cooling unit 180 forming a main curing device, which is disposed on the downstream side of the pressurizing and fixing unit 17. Furthermore, although not shown in the drawings, the heads 12K, 12M, 12C, 12Y and 12CL, and their respective ink supply units (14K, 14M, 14C, 14Y and 14CL) each have heaters (heating devices) for liquefying the phase change ink.

The phase change ink is kept in a high-temperature molten state inside the heads 12K, 12M, 12C, 12Y and 12CL, and is discharged in the form of liquid droplets from the heads 12K, 12M, 12C, 12Y and 12CL, when driven by the actuators 58.

The heating unit 160 includes a temperature-adjustable heater, in such a manner that the amount of heat required to kept the ink discharged from the heads 12K, 12M, 12C, 12Y and 12CL in a semiliquid or semimolten state of sufficient viscosity to prevent intermixing with inks of other colors, is applied to ink on the recording paper 20.

In other words, the ink deposited on the recording paper 20 is changed to a semimolten by the heat from the heating unit 160, and it is flattened by the pressurizing and fixing unit 17 while maintained in this semimolten state.

The cooling unit 180 according to the present example is constituted by fans 181 and 182 disposed in mutually opposing positions above and below the recording paper 20. By cooling the print surface and the rear surface of the recording paper 20 by blowing a cool air flow onto same from the fans 181 and 182, the ink on the recording paper 20 undergoes a phase change and becomes solidified and fixed.

Figure 20:
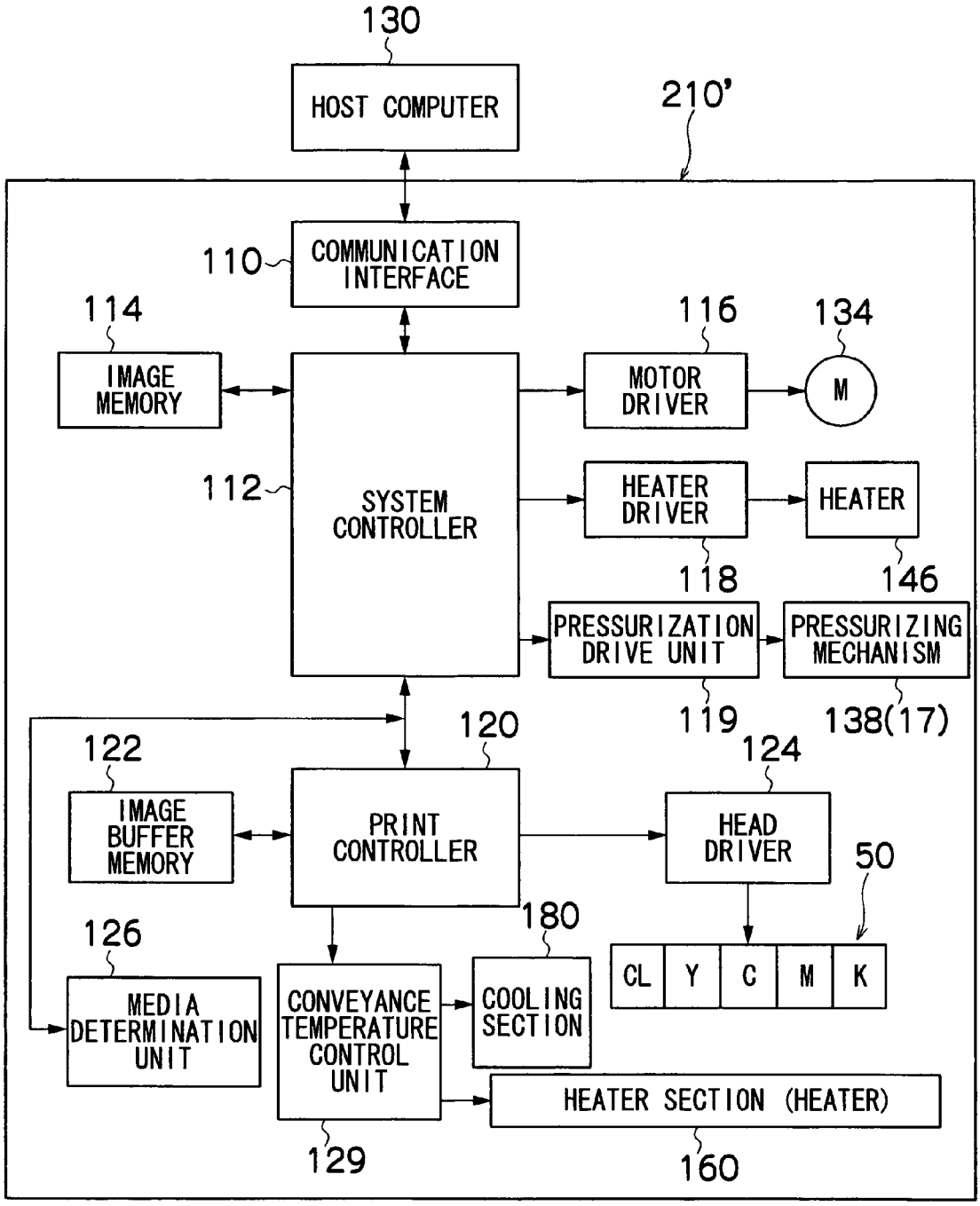
FIG. 20 is a principal block diagram showing the system composition of the image forming apparatus illustrated in FIG. 19.

FIG. 20 is a principal block diagram showing the system composition of the image forming apparatus 210' illustrated in FIG. 19. In FIG. 20, items which are the same as or similar to those in FIG. 17 are labeled with the same reference numerals and description thereof is omitted here.

Instead of the light source control unit 128, the semiliquid forming light sources 16 and the main curing light source 18 shown in FIG. 17, in the example in FIG. 20, a conveyance temperature controller 129, a heating unit 160 and a cooling unit 180 are provided, respectively.

The conveyance temperature controller 129 comprises a temperature control circuit that controls the on/off switching of the heating unit 160 and the amount of heat generated (the heating temperature), and the like, and a cooling control circuit for controlling the on/off switching and operational speed (wind force) of the fans 181 and 182 in the cooling unit 180. The conveyance temperature controller 129 controls the heating unit 160 and the cooling unit 180 in accordance with instructions from the print controller 120.

Figure 21:
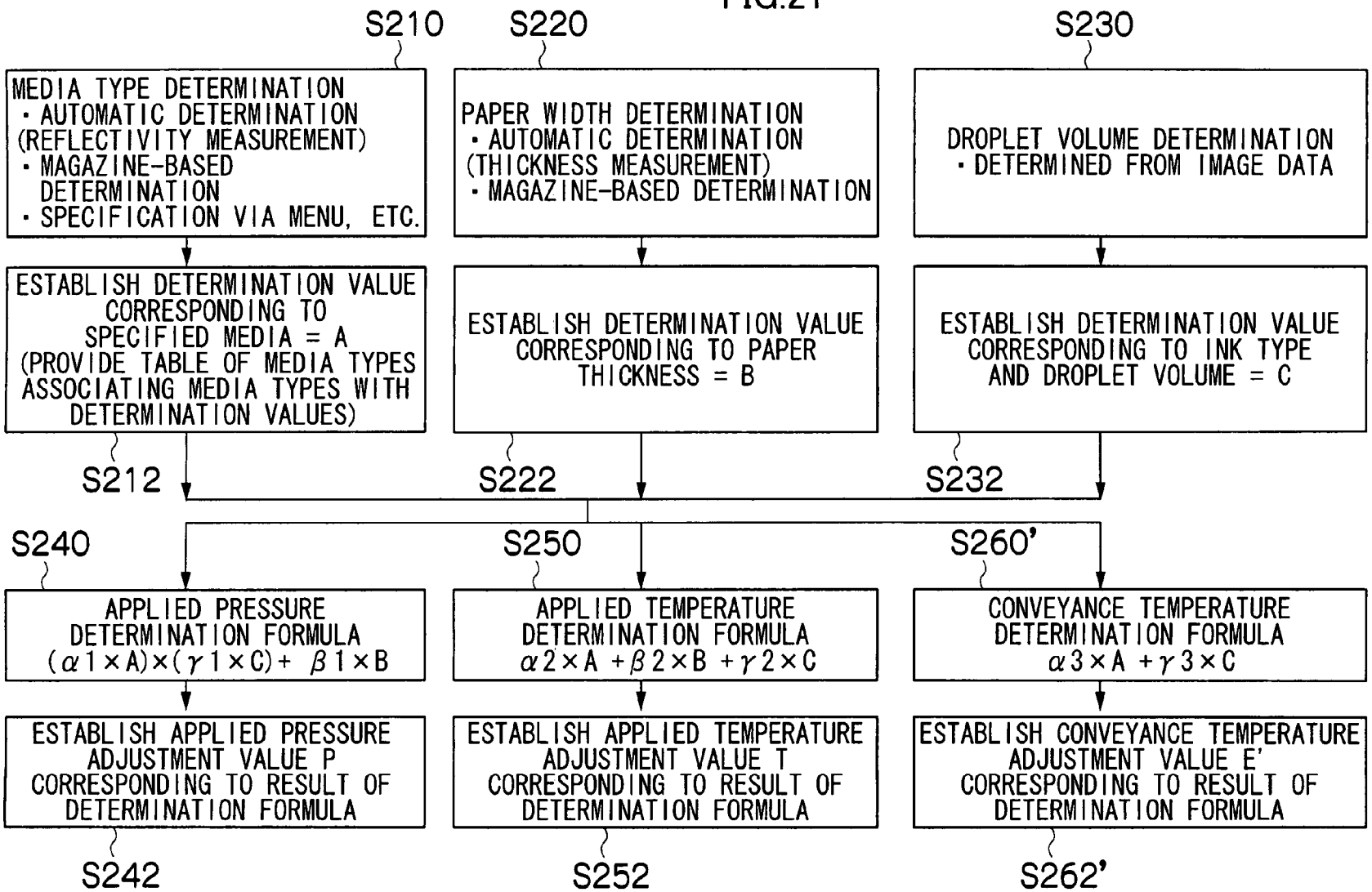
FIG. 21 is a flowchart showing an example of a control procedure in the image forming apparatus illustrated in FIG. 19.

FIG. 21 is a flowchart showing an example of a control algorithm of the image forming apparatus 210' illustrated in FIGS. 19 and 20. In FIG. 21, steps which are the same as or similar to those in the flowchart in FIG. 18 are labeled with the same step number and description thereof is omitted here.

In the flowchart in FIG. 21, steps S260' and S262' are included respectively in place of steps S260 and S262 in FIG. 18.

More specifically, at step S260', the following conveyance temperature determination formula (4) is calculated, using the determination values A, B and C determined at steps S212, S222 and S232:

$$\alpha 3 \times A + \gamma 3 \times C, \tag{4}$$

where the coefficients $\alpha 3$ and $\gamma 3$ are respective uniform values.

The result of this conveyance temperature determination formula (4) is derived, and a conveyance temperature adjustment value E' is established corresponding to this result (step S262'). Therefore, the heating temperature of the heating unit 160 is adjusted in accordance with the value of the conveyance temperature adjustment value E'.

The present embodiments have been described above with respect to a composition in which a plurality of full line heads are arranged respectively for different colors, but in implementing the present invention, it is also possible to adopt a head composition in which nozzle rows are formed respectively for different colors within an integrated multi-colour head. Furthermore, it is also possible to use a shuttle scanning type of head in which a short head is moved back and forth reciprocally, instead of the full line head.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming apparatus, comprising:

an ink discharge device comprising a plurality of full line type inkjet heads arranged separately for a plurality of inks of different colors, each of the inkjet heads having a nozzle row in which a plurality of nozzles for discharging droplets of the ink toward a surface of a recording medium are arranged through a length corresponding to a full width of the recording medium;

an ink supply device which supplies ultraviolet curable inks of corresponding colors to the inkjet heads;

a conveyance device which causes the inkjet heads and the recording medium to move relatively to each other by conveying at least one of the recording medium and the inkjet heads in a direction substantially perpendicular to a breadthways direction of the recording medium;

a first curing device which irradiates ultraviolet light for causing the droplets of the ink, deposited on the surface of the recording medium by one of the inkjet heads on an upstream side in a direction of relative conveyance of the recording medium with respect to the inkjet heads, to semi-cure to a degree whereby the droplets of the ink discharged from the inkjet head on the upstream side do not mix on the surface of the recording medium with the droplets of the ink discharged by a next one of the inkjet heads situated on a downstream side in the direction of relative conveyance, the first curing device comprising an ultraviolet light source including a group of light emitting elements arranged in a linear form and disposed between the inkjet heads of the respective colors;

a light source control device which controls at least one of a light emission range and a light emission intensity of the group of light emitting elements, in accordance with at least one condition of a width of the recording medium, a range of ink deposited by the inkjet head and a reflectivity of the recording medium; and a second curing device which irradiates ultraviolet light for performing main curing of the droplets of the ink on the recording medium to a degree whereby image degradation does not occur upon subsequent handling of the cured droplets of the ink, the second curing device being disposed after one of the inkjet heads situated in a furthest downstream position of the inkjet heads, wherein a wavelength range of said first curing device is narrower than a wavelength range of said second curing device.

2. The image forming apparatus as defined in claim 1, wherein the first curing device includes a lens which condenses the ultraviolet light emitted from the group of light emitting elements in a linear form in a direction that is substantially perpendicular to the direction of relative conveyance of the recording medium.

3. The image forming apparatus as defined in claim 1, wherein:

the first curing device comprises a first ultraviolet light source which generates electromagnetic waves including the ultraviolet light;

the second curing device comprises a second ultraviolet light source which generates electromagnetic waves including the ultraviolet light; and a wavelength range of the first ultraviolet light source in the first curing device is narrower than a wavelength range of the second ultraviolet light source in the second curing device.

4. The image forming apparatus as defined in claim 1, wherein:

the first curing device comprises a first ultraviolet light source which generates the ultraviolet light;

the second curing device comprises a second ultraviolet light source which generates the ultraviolet light; and an intensity of the ultraviolet light irradiated by the first ultraviolet light source in the first curing device is lower than an intensity of the ultraviolet light irradiated by the second ultraviolet light source in the second curing device.

5. The image forming apparatus as defined in claim 1, wherein:

the first curing device comprises a first ultraviolet light source which generates the ultraviolet light;

the second curing device comprises a second ultraviolet light source which generates the ultraviolet light; and a range of the ultraviolet light irradiated by the first ultraviolet light source in the first curing device is smaller than a range of the ultraviolet light irradiated by the second ultraviolet light source in the second curing device.

6. An image forming method for forming color images on a surface of a recording medium by a plurality of full line type inkjet heads separately arranged for a plurality of inks of different colors, each of the inkjet heads having a nozzle row wherein a plurality of nozzles for discharging droplets of the ink are arranged though a length corresponding to a full width of the recording medium, and discharging the droplets of the inks from the plurality of inkjet heads toward the surface of the recording medium, while causing the inkjet heads and the recording medium to move relatively to each other by conveying at least one of the recording medium and the inkjet heads in a direction substantially perpendicular to a breadthways direction of the recording medium, the method comprising the steps of:

using ultraviolet curable inks as the inks;

during a formation of an image by successive ink discharges of respective colors by the plurality of inkjet heads, performing a first curing process of irradiating ultraviolet light from an ultraviolet light source comprising a group of light emitting elements arranged in a linear form, onto the droplets of the ink deposited on the surface of the recording medium by a preceding one of the inkjet heads before discharge of the droplets of the ink by a subsequent one of the inkjet heads, in such a manner that the droplets of the ink deposited by the preceding inkjet head are semi-cured to a degree whereby the droplets of the ink discharged by the inkjet head of a preceding color in an ink discharge sequence do not mix on the surface of the recording medium with the droplets of the ink of another color discharged by the subsequent inkjet head;

controlling, for said first curing process, at least one of a light emission range and a light emission intensity of the group of light emitting elements, in accordance with at least one condition of a width of the recording medium, a range of ink deposited by the inkjet head and a reflectivity of the recording medium; and performing a second curing process of irradiating ultraviolet light for performing main curing of the droplets of the ink on the surface of the recording medium after the droplets of the ink have been discharged by a last one of the inkjet heads, to a degree whereby image degradation does not occur upon subsequent handling of the cured droplets of the ink, wherein a wavelength range used in said first curing process is narrower than a wavelength range used in said second curing process.

7. An image forming apparatus, comprising:

a discharge head having nozzles which discharge droplets of an ink toward a surface of a recording medium;

a conveyance device which causes the discharge head and the recording medium to move relatively to each other by conveying at least one of the discharge head and the recording medium;

a semiliquid forming curing device which causes the droplets of the ink discharged from the discharge head on a upstream side thereof to cure to a semiliquid state having a viscosity sufficient to prevent color mixing even if the droplets of the ink make contact with droplets of an ink of another color, the semiliquid forming curing device being disposed on a downstream side of the discharge head in a direction of relative conveyance of the recording medium with respect to the discharge head, wherein the semiliquid forming curing device comprises a light source including a group of light emitting elements arranged in a substantially linear form;

a flattening device which flattens the droplets of the ink on the surface of the recording medium, the flattening device being disposed on a downstream side of the semiliquid forming curing device; and a main curing device which performs main curing of the droplets of the ink on the surface of the recording medium to a degree whereby image degradation caused by ink smearing does not occur during subsequent conveyance and handling, the main curing device being disposed on a downstream side of the flattening device, wherein a wavelength range of said semiliquid forming device is narrower than a wavelength range of said main curing device.

8. The image forming apparatus as defined in claim 7, wherein the flattening device comprises a pressurizing device which applies pressure to the droplets of the ink on the surface of the recording medium.

9. The image forming apparatus as defined in claim 8, wherein the flattening device further comprises a heating device which heats the droplets of the ink on the surface of the recording medium.

10. The image forming apparatus as defined in claim 7, further comprising an ink supply device which supplies ink that is curable by application of energy to the discharge head.

11. The image forming apparatus as defined in claim 10, wherein:

a plurality of the discharge head are provided for inks of a plurality of colors, the plurality of discharge heads being disposed from an upstream side in order of ascending curing sensitivity of the inks upon application of energy; and a plurality of the semiliquid forming curing device are disposed on downstream sides of the plurality of discharge heads.

12. The image forming apparatus as defined in claim 7, further comprising a control device which controls at least one of flattening conditions of the flattening device and the energy applied by the semiliquid forming curing device in accordance with at least one condition of a type of recording medium, a type of ink and an amount of ink deposited.

13. The image forming apparatus as defined in claim 7, further comprising a discharge head which discharges a clear ink arranged after the discharge heads which discharge colored ink.

14. The image forming apparatus as defined in claim 7, further comprising a withdrawal drive mechanism which moves the flattening device from a prescribed flattening process position to a prescribed withdrawal position.

15. An image forming method for forming images on a surface of a recording medium by discharging ink from a discharge head having nozzles for discharging droplets of the ink toward the surface of the recording medium and causing the discharge head and the recording medium to move relatively to each other by conveying at least one of the discharge head and the recording medium, the method comprising:

a discharge step of discharging droplets of an ink curable by application of energy onto the recording medium by means of the discharge head;

a semiliquid forming curing step of causing the droplets of the ink discharged in the discharge step to cure to a semiliquid state having a viscosity sufficient to prevent color mixing even if the droplets of the ink make contact with droplets of an ink of another color on the surface of the recording medium, the semiliquid forming curing step irradiating light from a light source comprising a group of light emitting elements arranged in a substantially linear form;

a flattening step of flattening the droplets of the ink by applying pressure to the droplets of the ink in the semiliquid state on the surface of the recording medium; and a main curing step of performing main curing of the droplets of the ink on the surface of the recording medium, after the flattening step, to a degree whereby image degradation caused by ink smearing does not occur during subsequent conveyance and handling, wherein a wavelength range used in said semiliquid forming curing step is narrower than a wavelength range used in said main curing step.

16. The image forming apparatus as defined in claim 1, wherein each of the light emitting elements is an ultraviolet LED element or a laser diode, and the light emitting elements are selectively controlled.

17. The image forming apparatus as defined in claim 7, wherein the group of light emitting elements arranged in a substantially linear form is selectively energized, and the number of light emitting elements and the intensity of light emitted by each light emitting element are controlled in accordance with at least one of a size of the recording medium, a range over which the ink is deposited, and a reflectivity of the recording medium, to achieve at least one of an irradiation range, a light quantity or intensity distribution, and an increased energy density, in the irradiation area of the group of light emitting elements.

18. The image forming apparatus as defined in claim 7, wherein light emission positions and emitted light intensities of the light emitting elements are controlled in accordance with a size of the recording medium and a droplet ejection range of the discharge head, to minimize the amount of generated light.

19. The image forming apparatus as defined in claim 1, wherein the light emission range of the group of light emitting elements is controlled so as to cause the light emitting elements to emit light selectively according to regions for the droplets of the ink.

20. The image forming apparatus as defined in claim 1, wherein an intensity of the light emitted by each of the light emitting elements is controlled according to a reflectivity of the recording medium so that when the reflectivity of the recording medium is higher, an intensity of the light emitted by each of the light emitting elements during lighting is lower.

21. The image forming apparatus as defined in claim 1, wherein an intensity of the light emitted by each of the light emitting elements is controlled according to a droplet volume deposited in the irradiation area of one light emitting element.

22. The image forming apparatus as defined in claim 7, wherein the irradiation intensity of the semiliquid forming curing device is controlled in accordance with at least one of a size of the recording medium, a droplet volume of ink, and a type of the recording medium.

23. The image forming apparatus as defined in claim 7, wherein the ink is a light curable ink.

24. The image forming method as defined in claim 15, wherein the ink is a light curable ink.

25. An image forming apparatus, comprising:

an ink discharge device comprising a plurality of frill line type inkjet heads arranged separately for a plurality of inks of different colors, each of the inkjet heads having a nozzle row in which a plurality of nozzles for discharging droplets of the ink toward a surface of a recording medium are arranged through a length corresponding to a frill width of the recording medium;

an ink supply device which supplies ultraviolet curable inks of corresponding colors to the inkjet heads;

a conveyance device which causes the inkjet heads and the recording medium to move relatively to each other by conveying at least one of the recording medium and the inkjet heads in a direction substantially perpendicular to a breadthways direction of the recording medium;

a first curing device which irradiates ultraviolet light for causing the droplets of the ink, deposited on the surface of the recording medium by one of the inkjet heads on an upstream side in a direction of relative conveyance of the recording medium with respect to the inkjet heads, to semi-cure to a degree whereby the droplets of the ink discharged from the inkjet head on the upstream side do not mix on the surface of the recording medium with the droplets of the ink discharged by a next one of the inkjet heads situated on a downstream side in the direction of relative conveyance, the first curing device comprising an ultraviolet light source including a group of light emitting elements arranged in a linear form and disposed between the inkjet heads of the respective colors;

a light source control device which controls at least one of a light emission range and a light emission intensity of the group of light emitting elements, in accordance with at least one condition of a width of the recording medium, a range of ink deposited by the inkjet head and a reflectivity of the recording medium; and a second curing device which irradiates ultraviolet light for performing main curing of the droplets of the ink on the recording medium to a degree whereby image degradation does not occur upon subsequent handling of the cured droplets of the ink, the second curing device being disposed after one of the inkjet heads situated in a frirthest downstream position of the inkjet heads, wherein light intensity irradiated by said first curing device is smaller than light intensity irradiated by said second curing device.

26. An image forming method for forming color images on a surface of a recording medium by a plurality of full line type inkjet heads separately arranged for a plurality of inks of different colors, each of the inkjet heads having a nozzle row wherein a plurality of nozzles for discharging droplets of the ink are arranged through a length corresponding to a full width of the recording medium, and discharging the droplets of the inks from the plurality of inkjet heads toward the surface of the recording medium, while causing the inkjet heads and the recording medium to move relatively to each other by conveying at least one of the recording medium and the inkjet heads in a direction substantially perpendicular to a breadthways direction of the recording medium, the method comprising the steps of:

using ultraviolet curable inks as the inks;

during a formation of an image by successive ink discharges of respective colors by the plurality of inkjet heads, performing a first curing process of irradiating ultraviolet light from an ultraviolet light source comprising a group of light emitting elements arranged in a liner form, onto the droplets of the ink deposited on the surface of the recording medium by a preceding one of the inkjet heads before discharge of the droplets of the ink by a subsequent one of the inkjet heads, in such a manner that the droplets of the ink deposited by the preceding inkjet head are semi-cured to a degree whereby the droplets of the ink discharged by the inkjet head of a preceding color in an ink discharge sequence do not mix on the surface of the recording medium with the droplets of the ink of another color discharged by the subsequent inkjet head;

controlling, for said first curing process, at least one of a light emission range and a light emission intensity of the group of light emitting elements, in accordance with at least one condition of a width of the recording medium, a range of ink deposited by the inkjet head and a reflectivity of the recording medium; and performing a second curing process of irradiating ultraviolet light for performing main curing of the droplets of the ink on the surface of the recording medium after the droplets of the ink have been discharged by a last one of the inkjet heads, to a degree whereby image degradation does not occur upon subsequent handling of the cured droplets of the ink, wherein light intensity irradiated in said first curing process is smaller than light intensity irradiated in said second curing process.

27. An image forming apparatus, comprising:

a discharge head having nozzles which discharge droplets of an ink toward a surface of a recording medium;

a conveyance device which causes the discharge head and the recording medium to move relatively to each other by conveying at least one of the discharge head and the recording medium;

a semiliquid forming curing device which causes the droplets of the ink discharged from the discharge head on a upstream side thereof to cure to a semiliquid state having a viscosity sufficient to prevent color mixing even if the droplets of the ink make contact with droplets of an ink of another color, the semiliquid forming curing device being disposed on a downstream side of the discharge head in a direction of relative conveyance of the recording medium with respect to the discharge head, wherein the semiliquid forming curing device comprises a light source including a group of light emitting elements arranged in a substantially linear form;

a flattening device which flattens the droplets of the ink on the surface of the recording medium, the flattening device being disposed on a downstream side of the semiliquid forming curing device; and a main curing device which performs main curing of the droplets of the ink on the surface of the recording medium to a degree whereby image degradation caused by ink smearing does not occur during subsequent conveyance and handling, the main curing device being disposed on a downstream side of the flattening device, wherein light intensity irradiated by said semiliquid forming curing device is smaller than light intensity irradiated by said main curing device.

28. An image forming method for forming images on a surface of a recording medium by discharging ink from a discharge head having nozzles for discharging droplets of the ink toward the surface of the recording medium and causing the discharge head and the recording medium to move relatively to each other by conveying at least one of the discharge head and the recording medium, the method comprising:

a discharge step of discharging droplets of an ink curable by application of energy onto the recording medium by means of the discharge head;

a semiliquid forming curing step of causing the droplets of the ink discharged in the discharge step to cure to a semiliquid state having a viscosity sufficient to prevent color mixing even if the droplets of the ink make contact with droplets of an ink of another color on the surface of the recording medium, the semiliquid forming curing step irradiating light from a light source comprising a group of light emitting elements arranged in a substantially linear form;

a flattening step of flattening the droplets of the ink by applying pressure to the droplets of the ink in the semiliquid state on the surface of the recording medium; and a main curing step of performing main curing of the droplets of the ink on the surface of the recording medium, after the flattening step, to a degree whereby image degradation caused by ink smearing does not occur during subsequent conveyance and handling, wherein light intensity irradiated in said semiliquid forming curing step is smaller than light intensity irradiated in said main curing step.

29. An image forming apparatus, comprising:

an ink discharge device comprising a plurality of full line type inkjet heads arranged separately for a plurality of inks of different colors, each of the inkjet heads having a nozzle row in which a plurality of nozzles for discharging droplets of the ink toward a surface of a recording medium are arranged through a length corresponding to a full width of the recording medium;

an ink supply device which supplies ultraviolet curable inks of corresponding colors to the inkjet heads;

a conveyance device which causes the inkjet heads and the recording medium to move relatively to each other by conveying at least one of the recording medium and the inkjet heads in a direction substantially perpendicular to a breadthways direction of the recording medium;

a first curing device which irradiates ultraviolet light for causing the droplets of the ink, deposited on the surface of the recording medium by one of the inkjet heads on an upstream side in a direction of relative conveyance of the recording medium with respect to the inkjet heads, to semi-cure to a degree whereby the droplets of the ink discharged from the inkjet head on the upstream side do not mix on the surface of the recording medium with the droplets of the ink discharged by a next one of the inkjet heads situated on a downstream side in the direction of relative conveyance, the first curing device comprising an ultraviolet light source including a group of light emitting elements arranged in a linear form and disposed between the inkjet heads of the respective colors;

a light source control device which controls at least one of a light emission range and a light emission intensity of the group of light emitting elements, in accordance with at least one condition of a width of the recording medium, a range of ink deposited by the inkjet head and a reflectivity of the recording medium; and a second curing device which irradiates ultraviolet light for performing main curing of the droplets of the ink on the recording medium to a degree whereby image degradation does not occur upon subsequent handling of the cured droplets of the ink, the second curing device being disposed after one of the inkjet heads situated in a furthest downstream position of the inkjet heads, wherein an irradiation range of said first curing device is narrower than an irradiation range of said second curing device.

30. An image forming method for forming color images on a surface of a recording medium by a plurality of full line type inkjet heads separately arranged for a plurality of inks of different colors, each of the inkjet heads having a nozzle row wherein a plurality of nozzles for discharging droplets of the ink are arranged through a length corresponding to a fUll width of the recording medium, and discharging the droplets of the inks from the plurality of inkjet heads toward the surface of the recording medium, while causing the inkjet heads and the recording medium to move relatively to each other by conveying at least one of the recording medium and the inkjet heads in a direction substantially perpendicular to a breadthways direction of the recording medium, the method comprising the steps of:

using ultraviolet curable inks as the inks;

during a formation of an image by successive ink discharges of respective colors by the plurality of inkjet heads, performing a first curing process of irradiating ultraviolet light from an ultraviolet light source comprising a group of light emitting elements arranged in a linear form, onto the droplets of the ink deposited on the surface of the recording medium by a preceding one of the inkjet heads before discharge of the droplets of the ink by a subsequent one of the inkjet heads, in such a manner that the droplets of the ink deposited by the preceding inkjet head are semi-cured to a degree whereby the droplets of the ink discharged by the inkjet head of a preceding color in an ink discharge sequence do not mix on the surface of the recording medium with the droplets of the ink of another color discharged by the subsequent inkjet head;

controlling, for said first curing process, at least one of a light emission range and a light emission intensity of the group of light emitting elements, in accordance with at least one condition of a width of the recording medium, a range of ink deposited by the inlcjet head and a reflectivity of the recording medium; and performing a second curing process of irradiating ultraviolet light for performing main curing of the droplets of the ink on the surface of the recording medium after the droplets of the ink have been discharged by a last one of the inkjet heads, to a degree whereby image degradation does not occur upon subsequent handling of the cured droplets of the ink, wherein an irradiation range for said first curing process is narrower than an irradiation range for said second curing process.

31. An image forming apparatus, comprising:

a discharge head having nozzles which discharge droplets of an ink toward a surface of a recording medium;

a conveyance device which causes the discharge head and the recording medium to move relatively to each other by conveying at least one of the discharge head and the recording medium;

a semiliquid forming curing device which causes the droplets of the ink discharged from the discharge head on a upstream side thereof to cure to a semiliquid state having a viscosity sufficient to prevent color mixing even if the droplets of the ink make contact with droplets of an ink of another color, the semiliquid forming curing device being disposed on a downstream side of the discharge head in a direction of relative conveyance of the recording medium with respect to the discharge head, wherein the semiliquid forming curing device comprises a light source including a group of light emitting elements arranged in a substantially linear form;

a flattening device which flattens the droplets of the ink on the surface of the recording medium, the flattening device being disposed on a downstream side of the semiliquid forming curing device; and a main curing device which performs main curing of the droplets of the ink on the surface of the recording medium to a degree whereby image degradation caused by ink smearing does not occur during subsequent conveyance and handling, the main curing device being disposed on a downstream side of the flattening device, wherein an irradiation range of said semiliquid forming curing device is narrower than an irradiation range of said main curing device.

32. An image forming method for forming images on a surface of a recording medium by discharging ink from a discharge head having nozzles for discharging droplets of the ink toward the surface of the recording medium and causing the discharge head and the recording medium to move relatively to each other by conveying at least one of the discharge head and the recording medium, the method comprising:

a discharge step of discharging droplets of an ink curable by application of energy onto the recording medium by means of the discharge head;

a semiliquid forming curing step of causing the droplets of the ink discharged in the discharge step to cure to a semiliquid state having a viscosity sufficient to prevent color mixing even if the droplets of the ink make contact with droplets of an ink of another color on the surface of the recording medium, the semiliquid fonning curing step irradiating light from a light source comprising a group of light emitting elements arranged in a substantially linear form;

a flattening step of flattening the droplets of the ink by applying pressure to the droplets of the ink in the semiliquid state on the surface of the recording medium; and a main curing step of performing main curing of the droplets of the ink on the surface of the recording medium, after the flattening step, to a degree whereby image degradation caused by ink smearing does not occur during subsequent conveyance and handling, wherein an irradiation range for said semiliquid forming curing step is narrower than an irradiation range for said main curing step.

33. An image forming apparatus, comprising:

an ink discharge device comprising a plurality of full line type inkjet heads arranged separately for a plurality of inks of different colors, each of the inkjet heads having a nozzle row in which a plurality of nozzles for discharging droplets of the ink toward a surface of a recording medium are arranged through a length corresponding to a full width of the recording medium;

an ink supply device which supplies ultraviolet curable inks of corresponding colors to the inkjet heads;

a conveyance device which causes the inkjet heads and the recording medium to move relatively to each other by conveying at least one of the recording medium and the inkjet heads in a direction substantially perpendicular to a breadthways direction of the recording medium;

a first curing device which irradiates ultraviolet light for causing the droplets of the ink, deposited on the surface of the recording medium by one of the inkjet heads on an upstream side in a direction of relative conveyance of the recording medium with respect to the inkjet heads, to semi-cure to a degree whereby the droplets of the ink discharged from the inkiet head on the upstream side do not mix on the surface of the recording medium with the droplets of the ink discharged by a next one of the inkjet heads situated on a downstream side in the direction of relative conveyance, the first curing device comprising an ultraviolet light source including a group of light emitting elements arranged in a linear form and disposed between the inkjet heads of the respective colors;

a second curing device which irradiates ultraviolet light for performing main curing of the droplets of the ink on the recording medium to a degree whereby image degradation does not occur upon subsequent handling of the cured droplets of the ink, the second curing device being disposed after one of the inkjet heads situated in a furthest downstream position of the inkjet heads; and a light control source unit which controls the group of light emitting elements in such a manner that the ultraviolet light is emitted selectively from the group of light emitting elements, controls an irradiation range of the group of light emitting elements, and controls light intensity irradiated by each of the light emitting elements according to reflectivity of the recording medium in such a manner that the higher the reflectivity of the recording medium is, the smaller the light intensity irradiated by each of the light emitting elements is.

34. An image forming apparatus, comprising:

an ink discharge device comprising a plurality of full line type inkjet heads arranged separately for a plurality of inks of different colors, each of the inkjet heads having a nozzle row in which a plurality of nozzles for discharging droplets of the ink toward a surface of a recording medium are arranged through a length corresponding to a full width of the recording medium;

an ink supply device which supplies ultraviolet curable inks of corresponding colors to the inkjet heads;

a conveyance device which causes the inkjet heads and the recording medium to move relatively to each other by conveying at least one of the recording medium and the inkjet heads in a direction substantially perpendicular to a breadthways direction of the recording medium;

a first curing device which irradiates ultraviolet light for causing the droplets of the ink, deposited on the surface of the recording medium by one of the inkjet heads on an upstream side in a direction of relative conveyance of the recording medium with respect to the inkjet heads, to semi-cure to a degree whereby the droplets of the ink discharged from the inkjet head on the upstream side do not mix on the surface of the recording medium with the droplets of the ink discharged by a next one of the inkjet heads situated on a downstream side in the direction of relative conveyance, the first curing device comprising an ultraviolet light source including a group of light emitting elements arranged in a linear form and disposed between the inkjet heads of the respective colors;

a second curing device which irradiates ultraviolet light for performing main curing of the droplets of the ink on the recording medium to a degree whereby image degradation does not occur upon subsequent handling of the cured droplets of the ink, the second curing device being disposed after one of the inkjet heads situated in a furthest downstream position of the inkjet heads; and a light control source unit which determines volume of droplets of the ink deposited in an irradiation area of one of the light emitting elements on the recording medium according to image data relating to an image to be printed on the recording medium, and controls light intensity irradiated by each of the light emitting elements according to the volume of droplets of the ink deposited in the irradiation area in such a manner that the larger the volume of droplets of the ink deposited in the irradiation area is, the larger the light intensity irradiated by each of the light emitting elements is.

* * * * *